United States Patent [19]

Ainslie et al.

[11] 4,049,522

[45] Sept. 20, 1977

[54] LOW COERCIVITY IRON-SILICON MATERIAL, SHIELDS, AND PROCESS

[75] Inventors: Norman George Ainslie, Croton-on-Hudson; Robert Douglas Hempstead, Yorktown Heights; Swie-In Tan, Bedford Hills, all of N.Y.; Erich Philipp Valstyn, Los Gatos, Calif.

[73] Assignee: International Business Machines Corporation, Armonk, N.Y.

[21] Appl. No.: 662,198

[22] Filed: Feb. 26, 1976

[51] Int. Cl.[2] ..... C23C 15/00

[52] U.S. Cl. ..... 204/192 M; 252/62.55; 360/126; 428/433; 428/630; 428/631; 428/928; 29/603; 148/31.55

[58] Field of Search ..... 204/192 M; 427/128, 427/131, 132; 360/113, 120, 126; 252/62.55; 29/196.3, 603; 148/31.55; 390/174 NA; 428/432, 433

[56] References Cited

U.S. PATENT DOCUMENTS

| | | | |
|---|---|---|---|
| 3,271,718 | 9/1966 | Shaw | 336/219 |
| 3,670,278 | 6/1972 | Foster et al. | 336/213 |

FOREIGN PATENT DOCUMENTS

| | | | |
|---|---|---|---|
| 2,106,604 | 8/1972 | Germany | 148/31.55 |
| 2,148,898 | 4/1973 | Germany | 360/126 |

OTHER PUBLICATIONS

I. Pockrand et al., "Magnetic Domains in Thin Sputtered FeSi Films," *Phys. Stat. Sol.* (a) 27, 413 (1975).

H. Hieber, "On the Electron Microprobe Analysis of Structured Magnetic Thin Films," *Thin Solid Films,* 12, 29–34 (1972).

*Primary Examiner*—John H. Mack
*Assistant Examiner*—Aaron Weisstuch
*Attorney, Agent, or Firm*—Graham S. Jones, II

[57] ABSTRACT

Iron-silicon is sputtered onto a substrate to be used for a magnetic recording head from a target containing 4% to 7% of silicon with a substrate bias between −2.5 and −60 volts, anode-cathode spacing of about ½ to about 2 inches, a deposition rate of greater than 150A/min, a substrate temperature above 250° C, an argon pressure above 10 microns, and a single film thickness greater than 0.4 micron, a laminated film thickness greater than 0.05 micron, and R.F. input power above 8 watts/in².

3 Claims, 55 Drawing Figures

EFFECT OF SUBSTRATE BIAS VOLTAGE

EFFECT OF BIAS WITH VARYING COMPOSITION

PERMEABILITY AS A FUNCTION OF FREQUENCY

EFFECT OF ANODE—CATHODE SPACING
1"
270 Å/MIN.
MAGNETIZATION (VOLTS)
FIELD (Oe)

2"
208 Å/MIN.
MAGNETIZATION (VOLTS)
FIELD (Oe)

3"
167 Å/MIN.
MAGNETIZATION (VOLTS)
FIELD (Oe)

EFFECT OF DEPOSITION RATE

EFFECT OF SUBSTRATE BIAS $V_{BIAS}=-60$
MAGNETIZATION (VOLTS)
FIELD (Oe)
1.5
1.0
1.5
0
-0.5
-1.0
-1.5
-15
-10
-5
0
5
10

$V_{BIAS}=-40$
MAGNETIZATION (VOLTS)
FIELD (Oe)
1.5
1.0
1.5
0
-0.5
-1.0
-1.5
-10
-5
0
5
10
15

$V_{BIAS}=-20$
MAGNETIZATION (VOLTS)
FIELD (Oe)
1.5
1.0
1.5
0
-0.5
-1.0
-1.5
-20
-15
-10
-5
0
5
10
15

COERCIVITY VS SUBSTRATE BIAS VOLTAGE

EFFECT OF
SUBSTRATE TEMPERATURE

EFFECT OF ARGON PRESSURE

EFFECT OF FILM THICKNESS

LAMINATED FILM STRUCTURE

Fe — 6.1 % Si

LOW COERCIVITY IRON-SILICON MATERIAL, SHIELDS, AND PROCESS

BACKGROUND OF THE INVENTION

1. Field of the Invention

This invention relates to thin film deposits of iron-silicon. It also relates to low coercivity material for magnetic recording thin film heads, and this invention relates as well to metal working and, more particularly, to processes of mechanical manufacture of a magnetic transducer for use in magnetic recording.

2. Description of the Prior Art

U.S. Pat. No. 3,605,258 of Fisher et al shows a sputtering system for depositing a nonmagnetic material such as glass upon a portion of a bar of magnetic material upon the surface to provide a magnetic gap. Permalloy is later sputtered onto another portion of the bar with use of photoresist masks to control where the deposits are made.

K. Y. Ahn, "Magnetic Film for an Integrated Recording Head," IBM Technical Disclosure Bulletin, Vol. 13, No. 5, October 1970, p. 1185 describes deposition of iron-silicon films upon silicon wafers heated to 200° C by simultaneous evaporation of Si and Fe using two electron beams guns with a typical evaporation rate of 20–30 Angstrons/sec. Pressure was from $10^{-5}$ Torr to $6 \times 10^{-6}$ Torr. Silicon was 5–15% by weight in the resulting film. No low coercivity films were reported there and such techniques do not yield low coercivity film. The range of Si content is too large and the substrate temperature is far too low to produce proper thermal stresses.

I. Pockrand and J. Verweel, "Magnetic Domains in Thin Films I," Phys. Stat. Sol. (a) 27, 413 (1975) describe effects of argon sputtering gas pressure upon Fe - 5.8% Si for potential use in an integrated circuit memory with a coercivity of 11.3 Oe at $1.8 \times 10^{-3}$ Torr, which is unacceptably high and 1.3 Oe at $21 \times 10^{3}$ Torr which is better.

SUMMARY OF THE INVENTION

In accordance with this process of manufacturing magnetic transducing heads and the like, a substrate is placed upon the anode of an R.F. sputtering chamber. A target of iron-silicon containing 4–7% of silicon is placed upon the cathode. An R.F. potential is impressed upon the cathode for sputtering iron-silicon from the target onto the substrate to a desired thickness. A bias is maintained upon the anode and the substrate to be coated on the order of −2.5 to −60 volts. The substrate is maintained at a temperature above 250° C. The chamber is maintained at a pressure above the 10 micron range. Subsequently, the steps of sputtering iron-silicon are terminated by removing the R.F. potential from the anode and the cathode.

Further, in accordance with this invention, a magnetic transducing layer such as an electrically conductive layer for inductive sensing or an insulated magnetoresistive sensor sandwich is deposited upon the layer of iron-silicon. Upon the transducing layer, another layer of iron-silicon is deposited by the same process described above.

In still another aspect of this invention, sputtering is performed in an atmosphere of argon gas with a level of R.F. input power above the 8 watts/in 2 range or a cathode potential of greater than 1200 volts.

An object of this invention is to provide a process for making iron-silicon alloys with low coercivity, relatively high permeability, high magnetic moment, high electrical resistivity and high mechanical hardness.

Another object is to provide a low coercivity Fe-Si magnetic material and magnetic sensors incorporating such material.

THE PREFERRED EMBODIMENT

Figure 1:
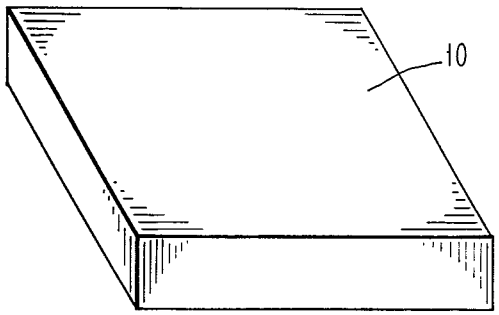
FIG. 1 shows a perspective view of a substrate.
Figure 2:
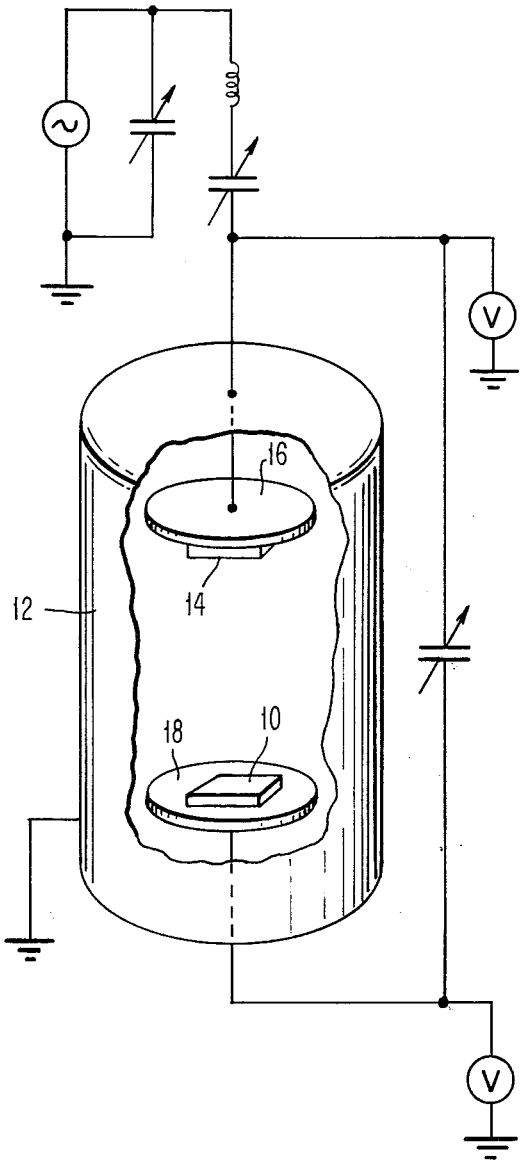
FIG. 2 shows a schematic of a simplified sputtering apparatus in accordance with this invention.
Figure 3:
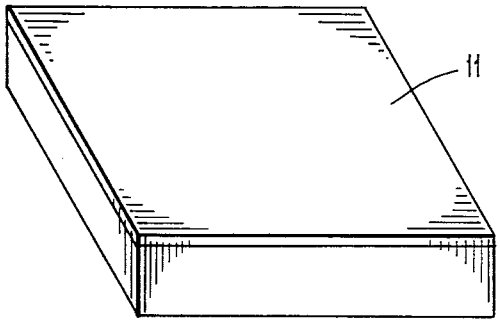
FIG. 3 shows the substrate of FIG. 1 after a layer of iron-silicon has been sputter deposited onto it.
Figure 4:
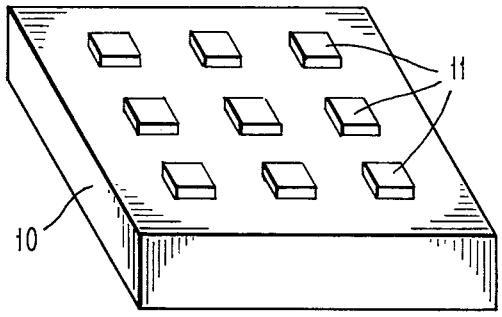
FIG. 4 shows the product of FIG. 3 after shielding squares of silicon-iron have been formed by subtractive processing.

FIG. 1 shows a substrate upon which a layer of silicon-iron is to be deposited in the sputtering chamber 12 in FIG. 2. The sputtering chamber 12 has its silicon-iron target 14 secured to cathode 16 and the substrate 10 rests on top of the anode 18, with an R.F. power source connected to cathode 16. Chamber 12 is grounded. Anode 18 is connected for negative bias through a variable capacitor to the cathode. A layer of iron-silicon 11 is deposited on substrate 10 as shown in FIG. 3. FIG. 4 shows a substrate 10 covered with a plurality of squares of iron-silicon 11 which have been formed from the product of FIG. 3 by means of applying resist and sputter etching or the like.

Figure 5:
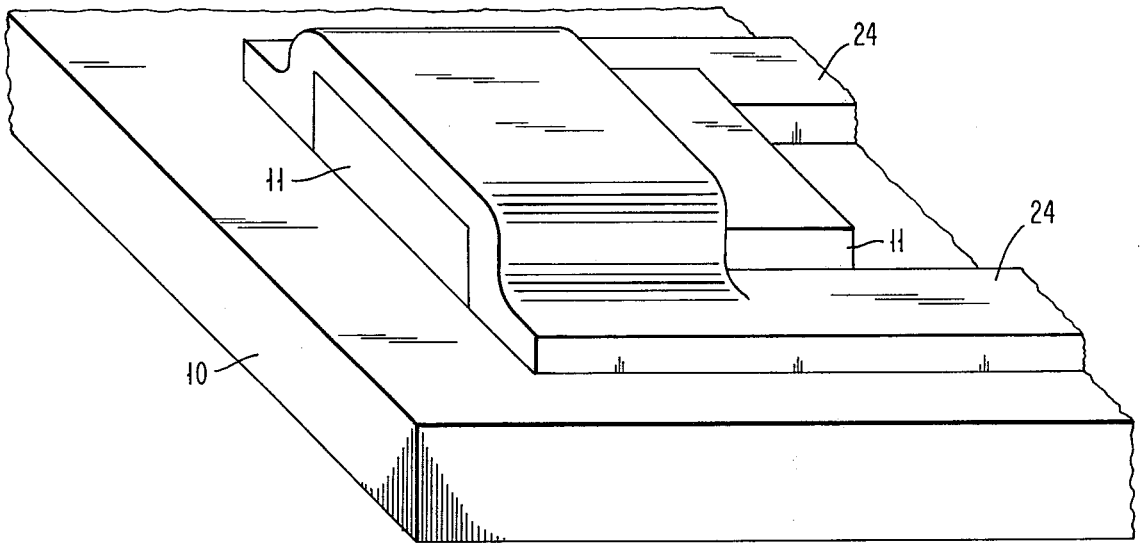
FIG. 5 shows the product of FIG. 4 after a copper magnetic recording element has been deposited on and around the squares in FIG. 4.

Subsequently, in FIG. 5 a layer of copper 24 can be deposited upon the tip of each of the site slabs to form a turn of a thin film magnetic head, with the site layer 11 0.5–10μm thick and the copper layer 24 0.5–1μm thick. The layer 24 is applied by vacuum depositing a titanium or chromium adhesion layer and then plating on copper.

The copper areas 24 are defined by applying photoresist and subtractive etching of the copper and the adhesion layer.

Figure 6:
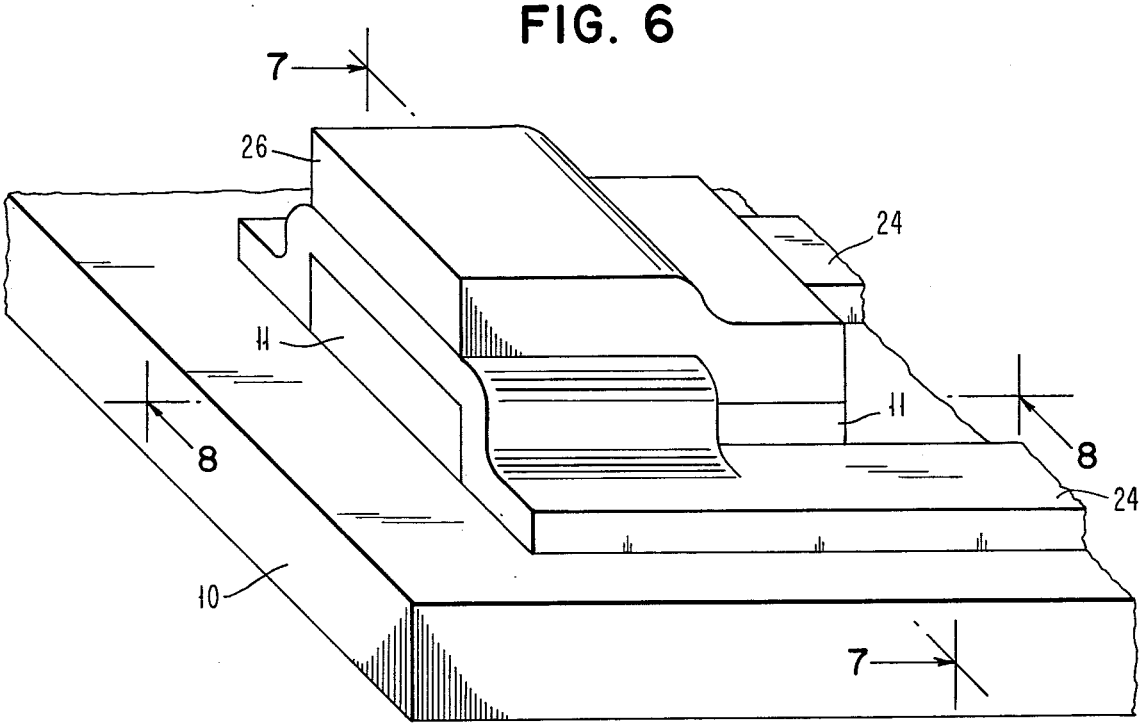
FIG. 6 shows a magnetic head from FIG. 5 which is formed by depositing another layer of shielding material over the layer of copper.
Figure 7:
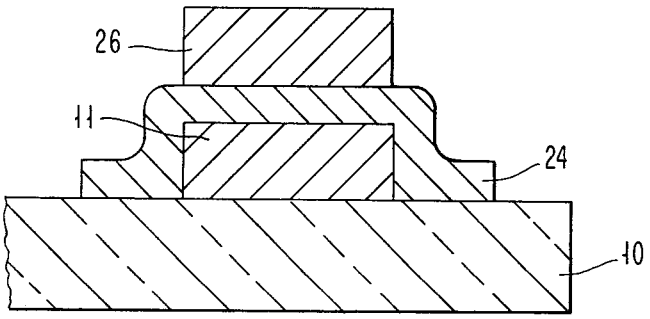
FIG. 7 shows a section along line 7—7 in FIG. 6.
Figure 8:
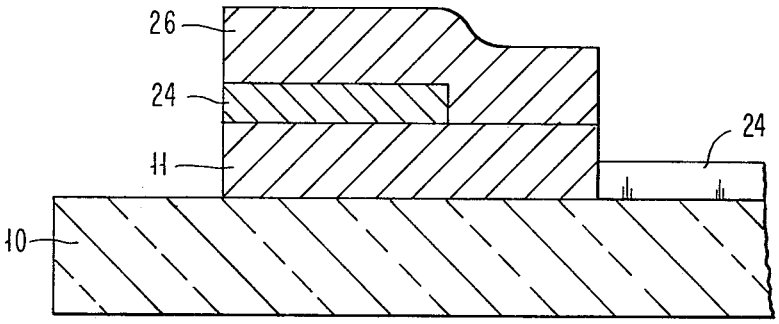
FIG. 8 shows a section along line 8—8 in FIG. 6.

In FIG. 6, another Fe-Si shield 26 is sputtered upon the copper layer, with FIGS. 7 and 8 showing the cross-sectional views of the Fe-Si shields as applied to a magnetic head. Again, techniques which are well known such as a subtractive etching technique are used to define the area upon which the Fe-Si layer 26 is deposited.

Iron-silicon alloys have the following desirable qualities:

1. Low coercivity (hence low hysteresis loss)
2. High saturation magnetization
3. High permeability
4. High resistivity (hence low eddy current loss and thus excellent high frequency response)
5. High mechanical hardness (hence, presumably, superior wear characteristics)
6. In bulk, Fe - 6% Si exhibits near-zero magnetostriction
7. Exhibits no magnetic aging phenomena For thin film applications in which magnetic softness is needed Fe-Si alloys have been virtually neglected in favor of Permalloy (Ni - 20% Fe). Permalloy (80–20, Ni-Fe) alloy is superior to Fe - 6% Si in regard to coercivity, low frequency permeability, and corrosion resistance. However, Permalloy (80–20, Ni-Fe) alloy is inferior to Fe - 6% Si alloy in regard to magnetic moment (10,000 g relative to 18,500 g for Fe - 6% Si), high frequency permeability (resistivity of 25 micro ohm cm for Permalloy relative to 85 micro ohm cm for Fe - 6% Si), mechanical hardness (translatable to wear resistance), and aging characteristics.

Because of those properties of Fe - 6% Si which excel over Permalloy (80–20, Ni-Fe) alloy and because other properties which do not excel would be entirely adequate for certain applications, this is an attractive process for manufacturing high quality Fe - 6% Si for use as magnetic shields and as inductive pole tips in thin film magnetic heads.

By judicious control of the deposition parameters of substrate temperature, substrate bias voltage and R.F. power level, it is possible routinely to sputter-deposit nominally Fe - 6% Si films having coercivities as low as 1.5 Oe. Films having coercivities as low as approximately 1 Oe in a single film can be deposited with this process. Coercivities below 1 Oe can be achieved by depositing laminated structures.

The crucial factors appear to be substrate temperature, deposition rate, and, for a given total R.F. power setting, substrate bias voltage. Good quality (i.e., low coercivity) films cannot be deposited unless the substrate temperature during deposition is sufficiently high. The range of allowable temperatures appears to be above 250° C. The minimum acceptable deposition rate appears to be above about 150A/min. Further, for a given sputtering target composition and R.F. input power level, there exists an optimum substrate bias voltage which results in films having a minimum coercivity.

A. Effect of Substrate Temperature

Figure 9:
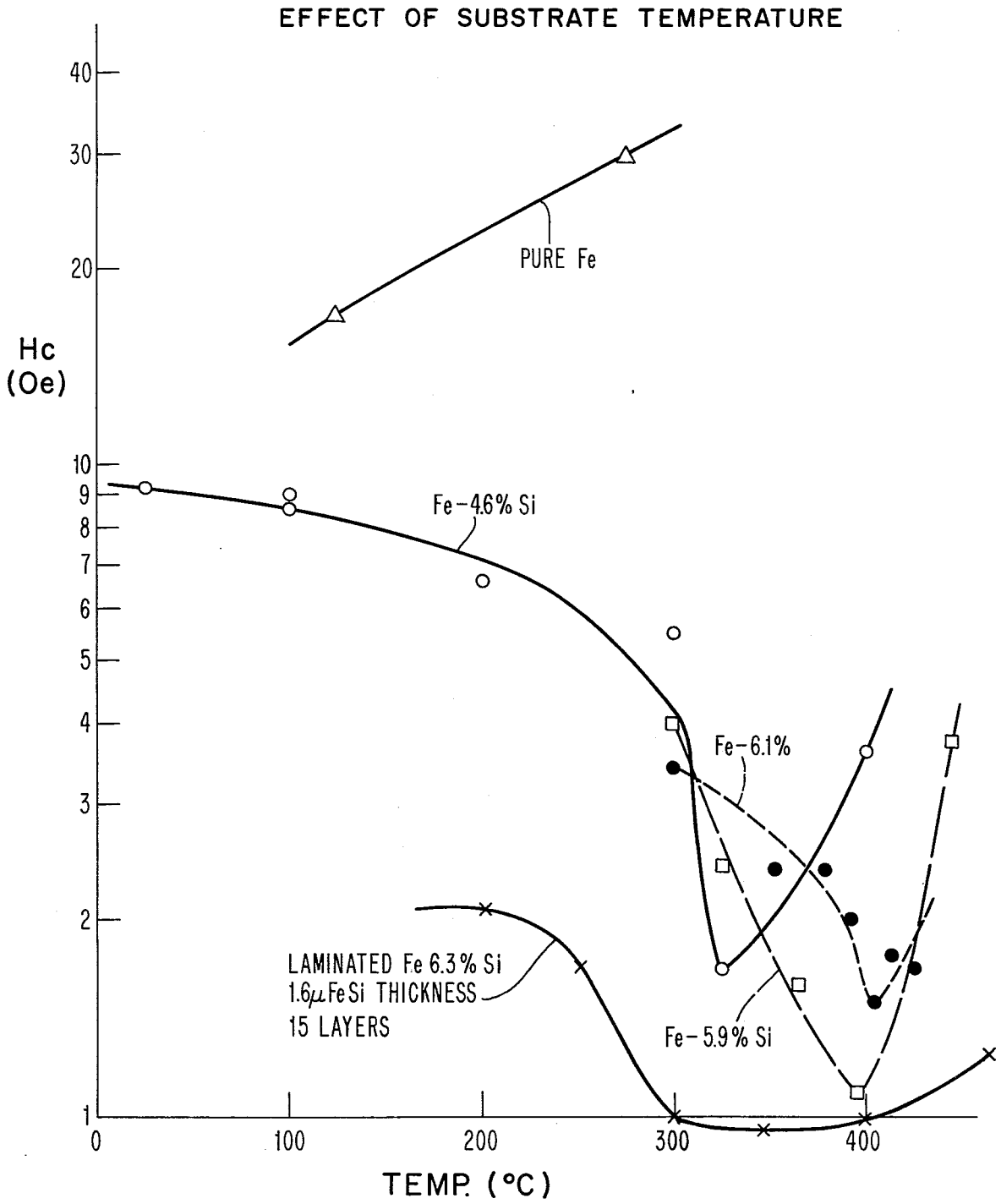
FIG. 9 shows a plot of coercivity vs. temperature demonstrating the effect of substrate temperature upon coercivity for various FeSi alloy targets.

FIG. 9 shows a plot of coercivity vs. temperature for several experiments in which the target composition is varied showing that the coercivity of pure iron increases as the substrate temperature increases because pure iron is highly magnetoresistive, and cooling to room temperature from relatively high substrate temperatures causes correspondingly high thermal stresses which markedly effect the magnetic properties, dominating other effects.

By contrast with the behavior of pure iron, the Fe - Si alloys shows initially decreasing coercivity with increasing substrate temperature, the coercivity decreasing very precipitously in the 325° – 400° C substrate temperature interval. The low substrate temperature behavior of the Fe - Si films results from the fact that the iron and silicon atoms comprising the growing films are unable, because of low surface or grain boundary atom mobility (both highly temperature dependent), to achieve a favorable metallurgical structure. Thus, the coercivity, being highly structure sensitive, takes on large values. Increasing substrate temperature results in an increasing atom mobility and a more stable metallurgical structure. Because of the relatively low magnetostriction of Fe - Si alloys, the above-mentioned good effects resulting from high substrate temperatures are not obliterated, and may in fact be enhanced, by the correspondingly higher thermal stresses when the films subsequently cool to room temperature.

Above a substrate temperature of 400° – 425° C, the coercivity is seen to increase due to the fact that the Fe - Si films, although having very low magnetostriction, do not have precisely zero magnetostriction; the relatively high thermal stresses that result upon cooling to room temperature now begin to dominate over the structure-sensitive effects mentioned above. Thus, the coercivity passes through a minimum with increasing substrate temperature.

It should be noted in FIG. 9 that the temperature at which the coercivity minimum occurs increases as the silicon content of the target increases. In a later example (FIG. 19) in which the target composition is Fe - 6.3% Si, it is seen that the coercivity minimum has not been reached even at 550° C. It was impractical to employ temperatures higher than 550° C in the experiments represented in FIG. 19.

B. Effect of Substrate Bias Voltage

Figure 10:
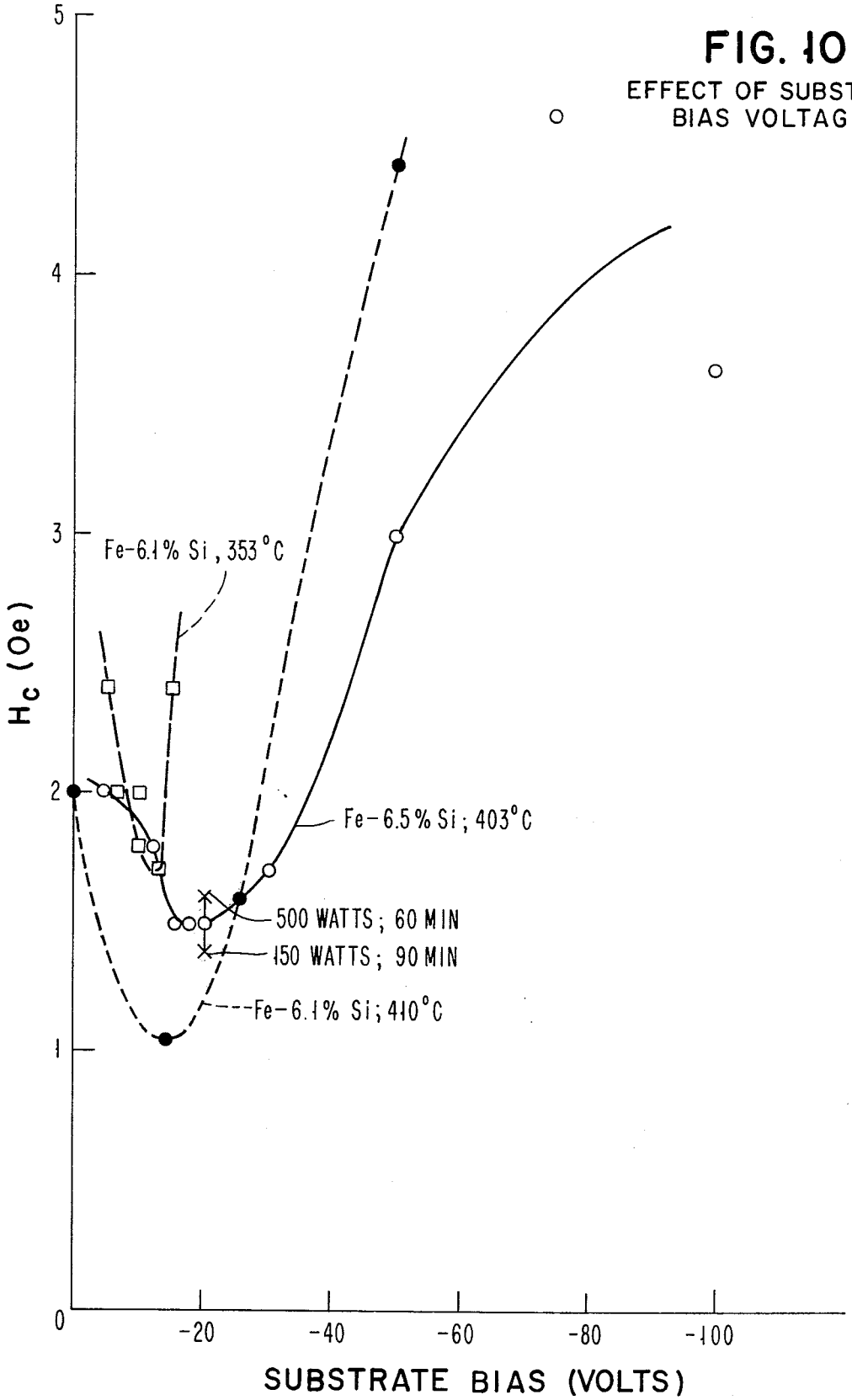
FIG. 10 shows a plot of coercivity vs. substrate bias voltage.

The dependence of the coercivity upon substrate bias voltage during sputtering is given in FIG. 10. The coercivity passes through a minimum at certain bias voltages; it can be seen in FIG. 10 that the depth of the coercivity minimum depends upon substrate temperature and bias voltage. The bias voltage at which the minimum occurs increases as the silicon content of the target increases, with best results obtained between −5 and −35 volts.

Figure 11:
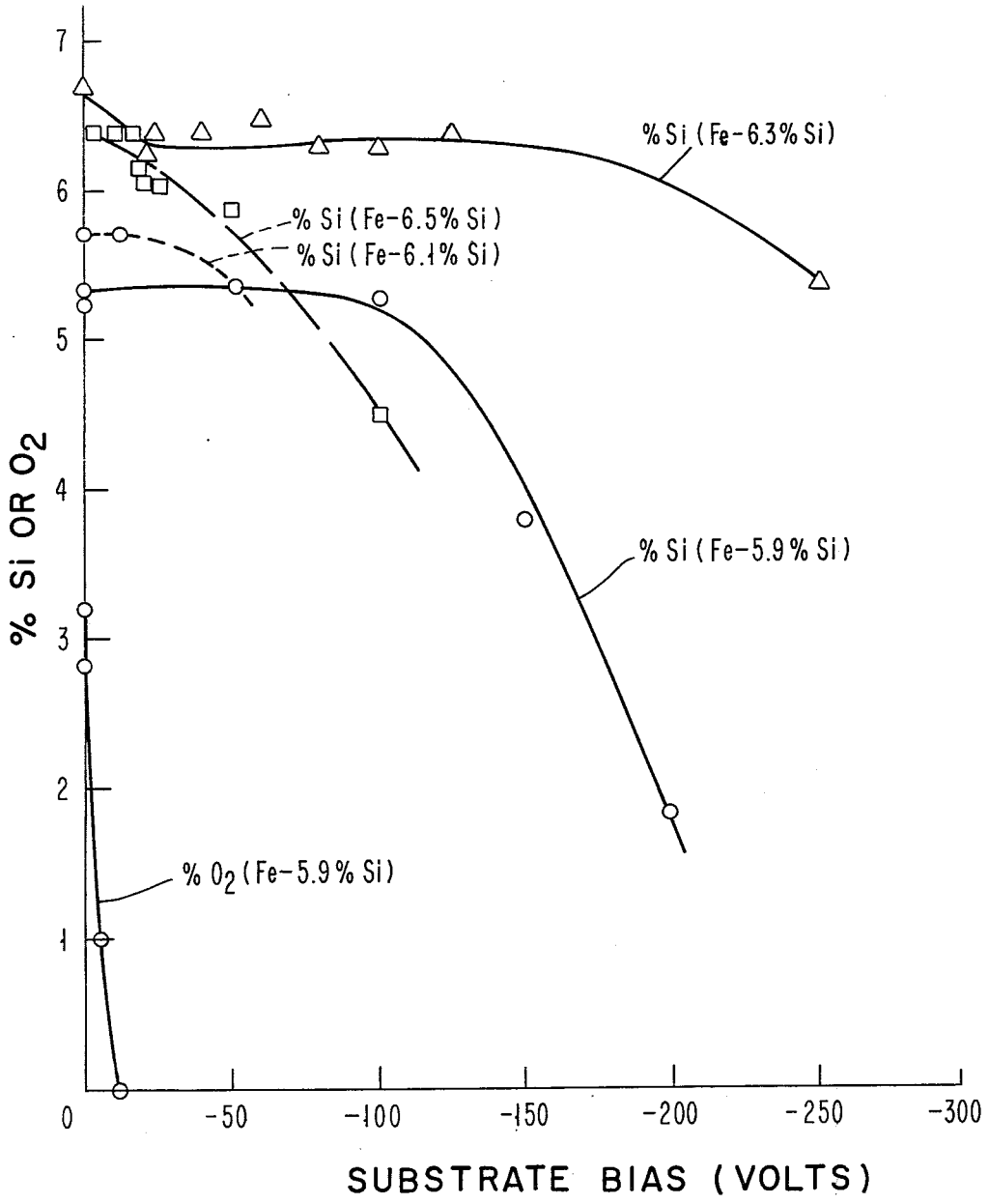
FIG. 11 shows a plot of silicon and oxygen content (weight percent) as a function of substrate biasing voltage.

FIG. 11 gives the dependence of the silicon and oxygen contents of the films as a function of substrate bias voltage during sputtering. It is clear in FIG. 11 that increasing negative substrate bias results in both decreasing oxygen and silicon contents of the films.

Whether the desirable effects of applying an optimum substrate bias voltage result from a reduced oxygen content, or from an optimized silicon content are not entirely clear at this point. However, it appears that in the low bias range, the effect is most dramatic upon the oxygen content, and less so upon the silicon content.

Nonetheless, the silicon content of those films which exhibit lower coercivities ranges from 5.5 - 6.1 weight percent silicon.

C. High Frequency Permeability

Figure 12:
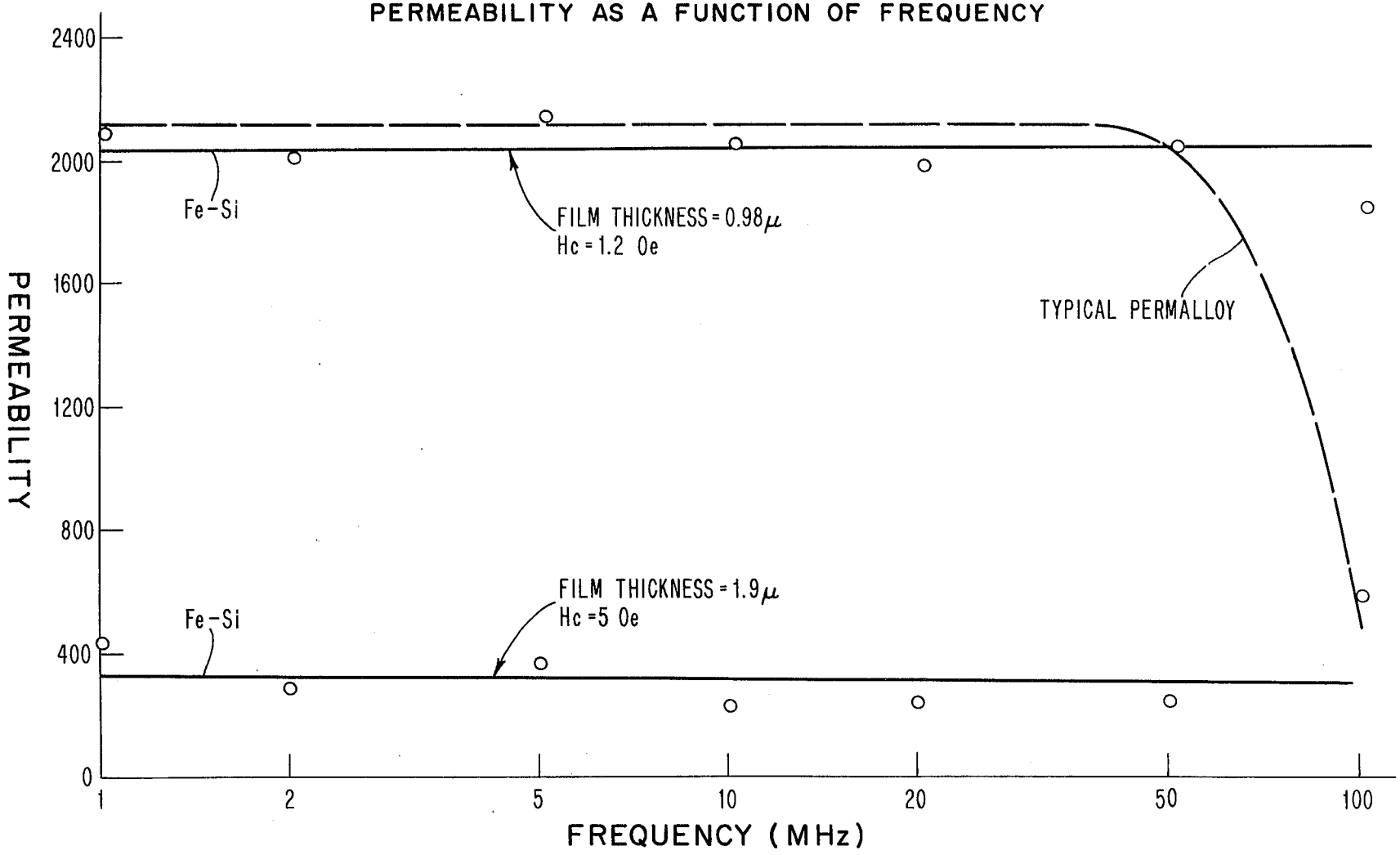
FIG. 12 shows a plot of permeability vs. frequency.

FIG. 12 gives the effective permeability of Fe - Si films as a function of frequency. It can be seen that the Fe - Si films exhibit permeabilities that remain constant, within experimental error, up to 100 $MH_z$. Further, the permeability of Permalloy (80–20, Ni-Fe) alloy is seen to roll off and become precipitously lower at frequencies beyond 40 - 50 $MH_z$ due to Permalloy's (80–20, Ni-Fe) alloy relatively low resistivity.

Also to be seen in FIG. 12 is the effect of an increasing coercivity upon the permeability of Fe - Si; not surprisingly, a roughly inverse relationship is seen to exist between permeability and coercivity, pointing up the importance of achieving low coercivity in these alloys.

SUMMARY

Using R.F. sputtering targets of Fe - Si containing 4.6, 5.9, 6.1 and 6.3 wt. % Si, it is possible to produce high quality, soft magnetic films of Fe - Si alloy for potential use in magnetic thin film heads. In particular, it has been possible to produce strong and adhering films having coercivities as low as 1 Oe, with a saturation magnetization of 18,500 Gauss and excellent high frequency response through the following process controls:

1. Maintain the R.F. input power above 8 watt/in$^2$ so as to maintain the deposition rate greater than 150A/min.
2. Maintain the argon sputtering gas above 10 microns.
3. Maintain the substrate temperature above 250° C to stabilize the metallurgical structure and to control the stress state.
4. Maintain the substrate bias constant in the range −2.5 to −60 volts to control film composition (Si, $O_2$ and Ar content).
5. Use a titanium sublimation pump in conjunction with a liquid nitrogen trap (or any other device having the equivalent function) to getter oxygen-bearing species from the incoming argon sputtering gas.

Effect of Anode - Cathode Separation

EXAMPLE I

An Fe - Si film was R.F. sputter deposited from an Fe - Si target onto an oxidized silicon wafer. The conditions were as follows:

| | |
|---|---|
| Target composition | Fe-6.3% Si |
| sputtering time | 60 minutes |
| Argon pressure | 10 microns |
| Substrate temperature | 400° C |
| R.F. power level | 10 watts/in$^2$ |
| Deposition rate | 270 Å/min |
| Anode-Cathode separation distance | 1 inch |
| Film thickness | 1.63 microns |
| Substrate bias | −10 volts |
| Cathode voltage | 1600 volts |
| Coercivity | 3.4 Oe |

Figures 13A, 13B, 13C:
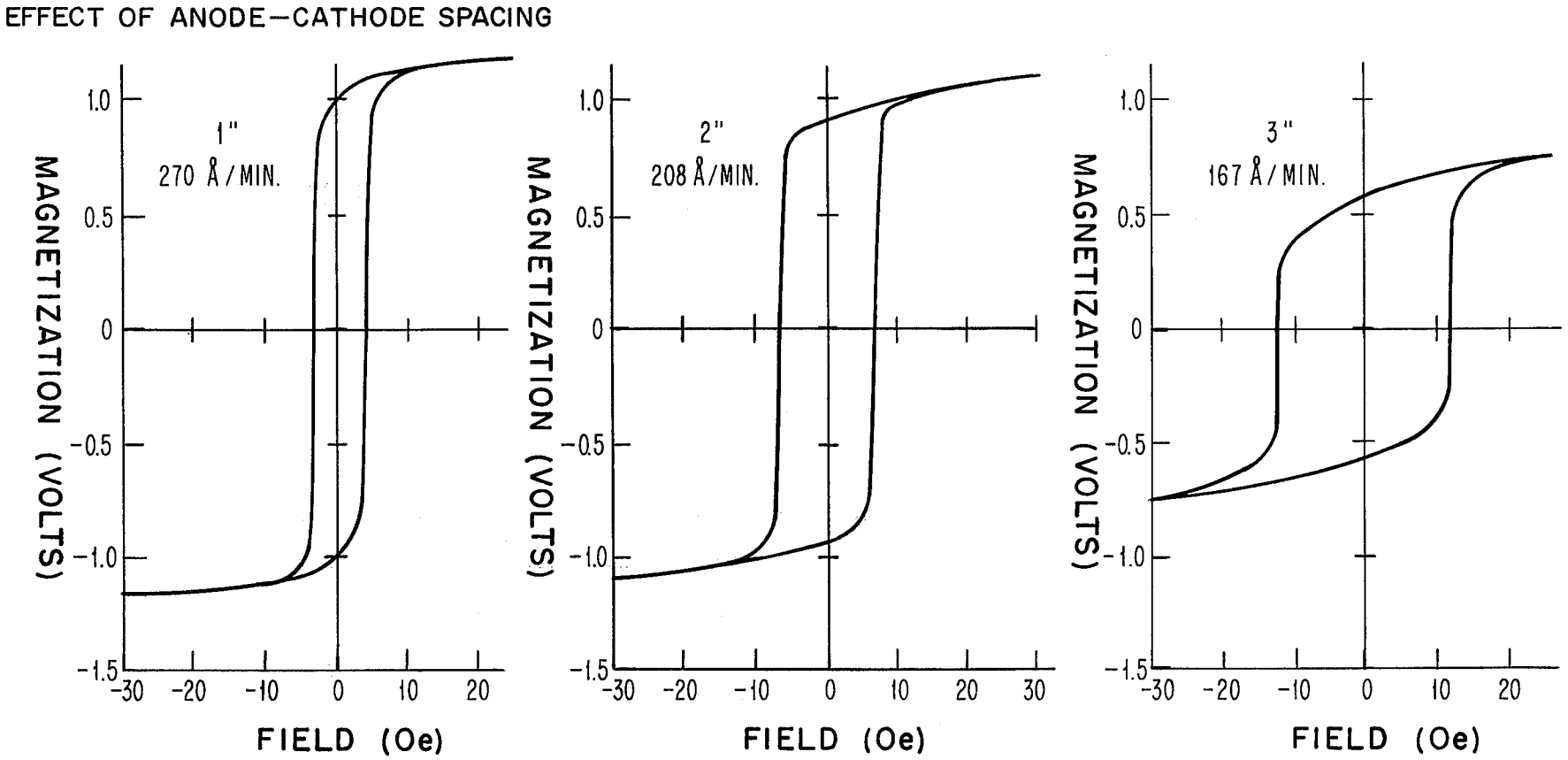
FIGS. 13A–C show hysteresis curves for varying anode-cathode separation.

The resultant film produced the hysteresis loop shown in FIG. 13A.

EXAMPLE II

All conditions were the same as in Example I except that the anode-cathode distance was two inches, the deposition rate was 208 A/min, cathode voltage was 1800 volts, the coercivity was 70 Oe, and the film thickness was 1.25 microns. That produced the hysteresis loop shown in FIG. 13B.

EXAMPLE III

The difference from Example I was that the anode-cathode distance was 3 inches, the coercivity was 12 Oe, the cathode voltage was 1800 volts, the deposition rate was 167 A/min, and the film thickness was 1.0 micron with the result shown in FIG. 13C.

FIGS. 13A–C show the changes in the hysteresis loops of single films of Fe-6.3%Si as a function of variation of anode-cathode spacing. Material thickness increases and coercivity decreases with decreasing separation, but FIG. 13A for 1 inch separation exhibits the shape qualities indicative of an in-plane anisotropy whereas FIG. 13C for 3 inch separation exhibits shape qualities indicative of a normal (out of plane) anisotropy.

Thus FIG. 13 suggests that varying anode-cathode separation distance at constant R.F. power may primarily effect the deposition rate, which may alter the stress state of the resulting film to change the nature of the magnetic anisotropy. The result is a change in the coercivity.

Effect of Deposition Rate

EXAMPLE IV

An Fe-Si film was R.F. sputter deposited from an Fe - Si target onto an oxidized silicon wafer. The conditions were as follows:

| | |
|---|---|
| Target composition | Fe-6.3% Si |
| Sputtering time | 30 minutes |
| Argon pressure | 20 microns |
| Substrate temperature | 400° C |
| R.F. power level | 20 watts/in$^2$ |
| Deposition rate | 600 Å/min |
| Anode-Cathode separation distance | 1.4 inches |
| Film thickness | 1.875 microns |
| Substrate bias | 0 volts |
| Cathode potential | 2350 volts |
| Coercivity | 5 Oe |

Figure 14A:
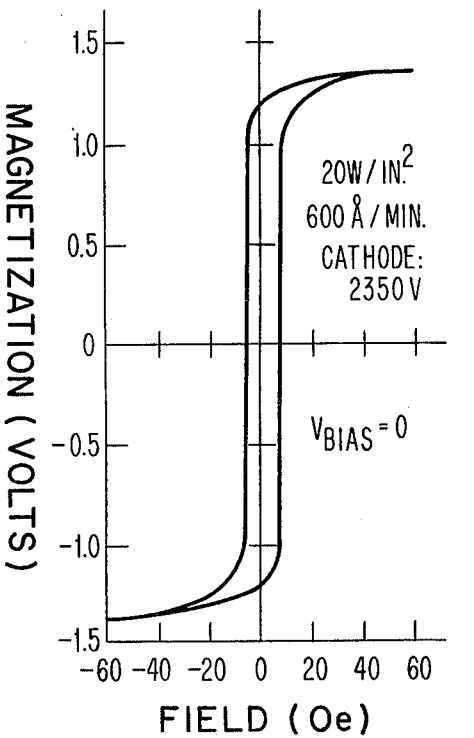
FIGS. 14A–F show hysteresis curves for varying deposition rates.

The resultant film produced the hysteresis loop shown in FIG. 14A, having a coercivity of 5 Oe. The high coercivity is attributable to lack of bias.

EXAMPLE V

Figure 14B:
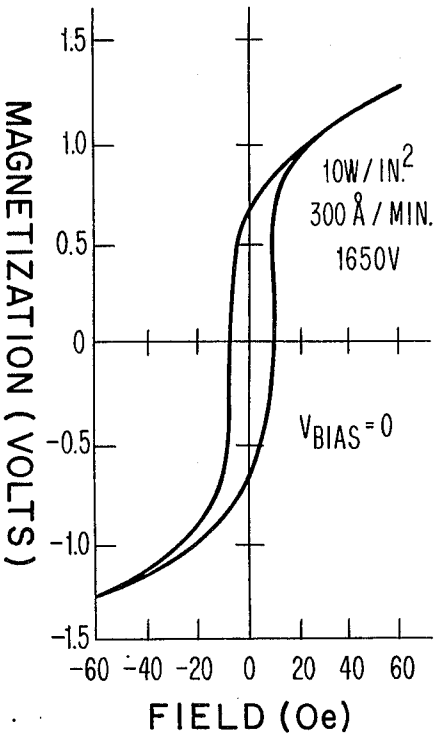

All conditions were the same as in Example IV except that the power level was 10 watts per square inch at a cathode potential of 1650 volts and a deposition rate of 300A/min for 60 minutes until a film thickness of 1.8 microns was reached. FIG. 14B shows the hysteresis loop produced, having a coercivity of 8 Oe.

EXAMPLE VI

Figure 14C:
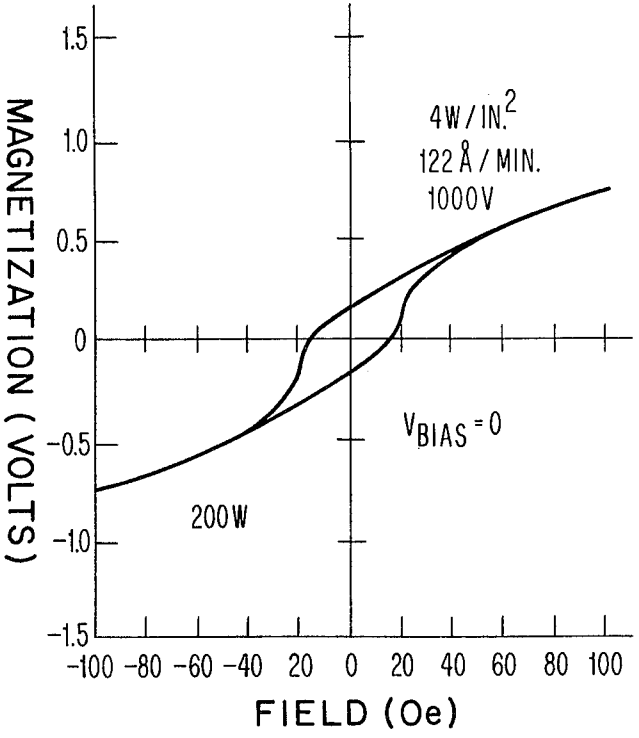

All conditions were the same as in Example IV except that the power level was 4 watts per square inch at a cathode potential of 1000 volts, a deposition rate of 122A/min for 147 minutes, until a 1.75 micron thickness was reached, yielding the hysteresis loop of FIG. 14C having a coercivity of 16 Oe.

The result of varying the deposition rate shown by Examples IV–VI and FIGS. 14A–C is that a high deposition rate, with film thickness held constant, yields an in-plane anisotropy and low coercivity whereas a low deposition rate yields a normal anisotropy and large coercivity.

Deposition Rate for Minus Forty Volts Bias

EXAMPLE VIA

An Fe-Si film was R.F. sputter deposited from an Fe-Si target onto an oxidized silicon wafer. The conditions were as follows:

| | |
|---|---|
| Target composition | Fe - 6.3% Si |
| Sputtering time | 34 minutes |
| Argon pressure | 15 microns |
| Substrate temperature | 400° C |
| R.F. power level | 20 watts/in$^2$ |
| Deposition rate | 600 Å/min |
| Anode-cathode separation distance | 1.4 inches |
| Film thickness | 1.5 microns |
| Substrate bias | −40 volts |
| Cathode voltage | 2150 volts |
| Coercivity | 2.8 Oe |

Figure 14D:
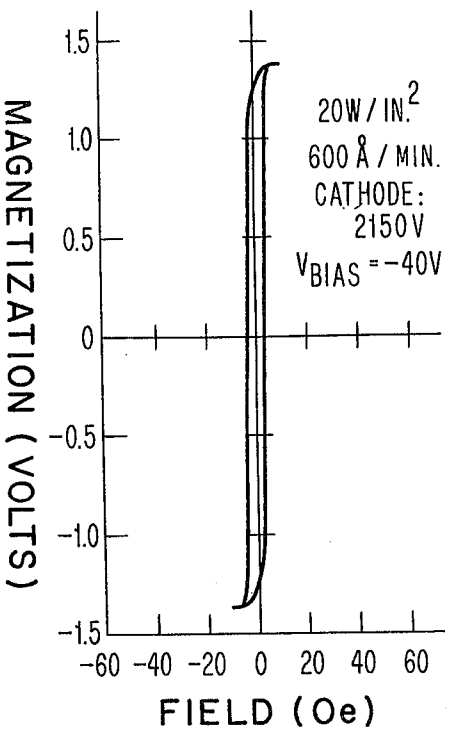

The resultant film produced the hysteresis loop shown in FIG. 14D.

EXAMPLE VIB

A sample was deposited as in Example VIA, except as follows:

| | |
|---|---|
| R.F. power level | 10 watts/in$^2$ |
| Sputtering time | 1½hours |
| Cathode voltage | 1350 volts |
| Deposition rate | 300 Å/min |
| Coercivity | 5 Oe |

Figure 14E:
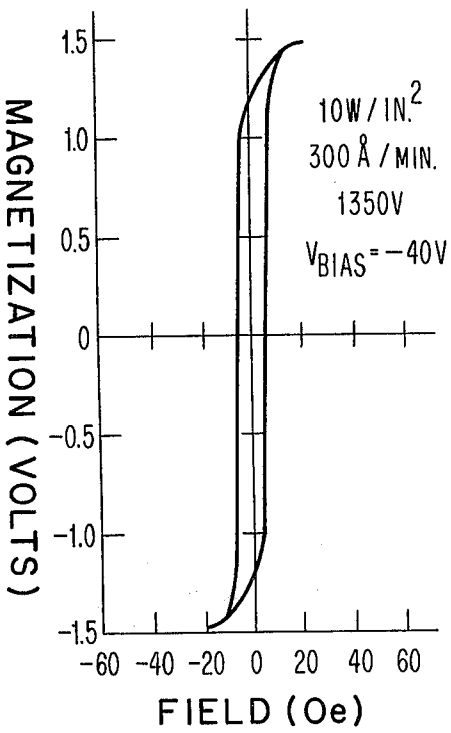

The resulting hysteresis loop is shown in FIG. 14E.

EXAMPLE VIC

A sample was deposited as in Example VIA, except as follows:

| | |
|---|---|
| R.F. power level | 4 watts/in$^2$ |
| Sputtering time | 3.75 hours |
| Cathode voltage | 800 volts |
| Deposition rate | 122 Å/min |
| Coercivity | 6 Oe |

Figure 14F:
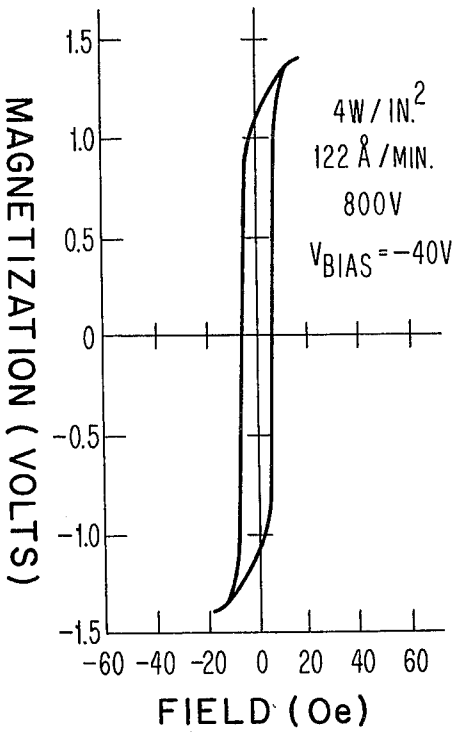

The resulting hysteresis loop is shown in FIG. 14F

Effect of Substrate Bias

EXAMPLE VII

An Fe - Si film was R.F. sputter deposited from an Fe - Si target onto an oxidized silicon wafer. The conditions were as follows:

| | |
|---|---|
| Target composition | Fe-6.3% Si |
| Sputtering time | 30 minutes |
| Argon pressure | 20 microns |
| Substrate temperature | 400° C |
| R.F. power level | 20 watts/in$^2$ |
| Deposition rate | 600 Å/min |
| Anode-Cathode separation distance | 1.4 inches |
| Film thickness | 1.865 microns |
| Substrate bias | 0volts |
| Cathode potential | 235 volts |
| Coercivity | 5 Oe |

Figure 15B:
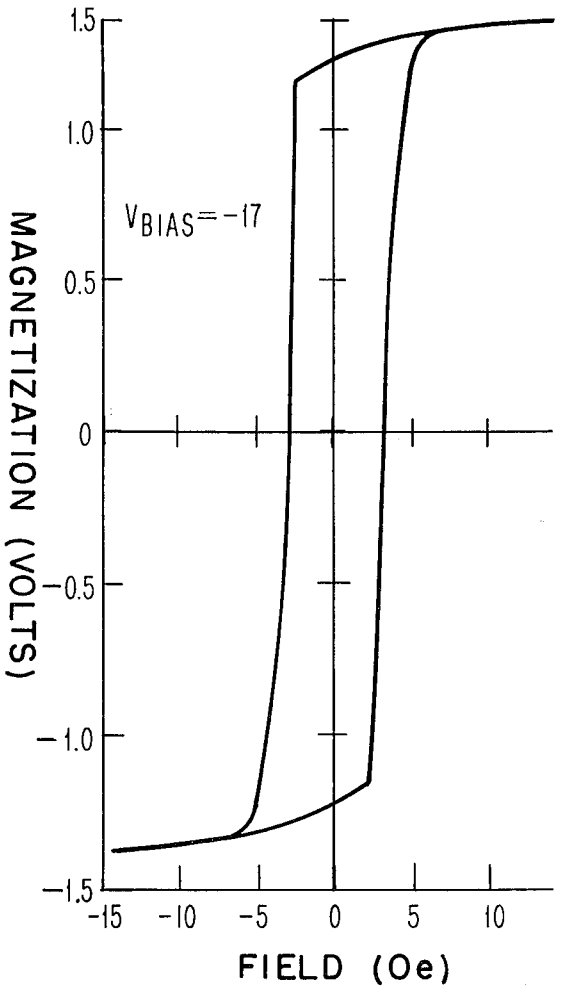
FIGS. 15A–I show hysteresis curves for varying values of substrate bias.
Figure 15A:
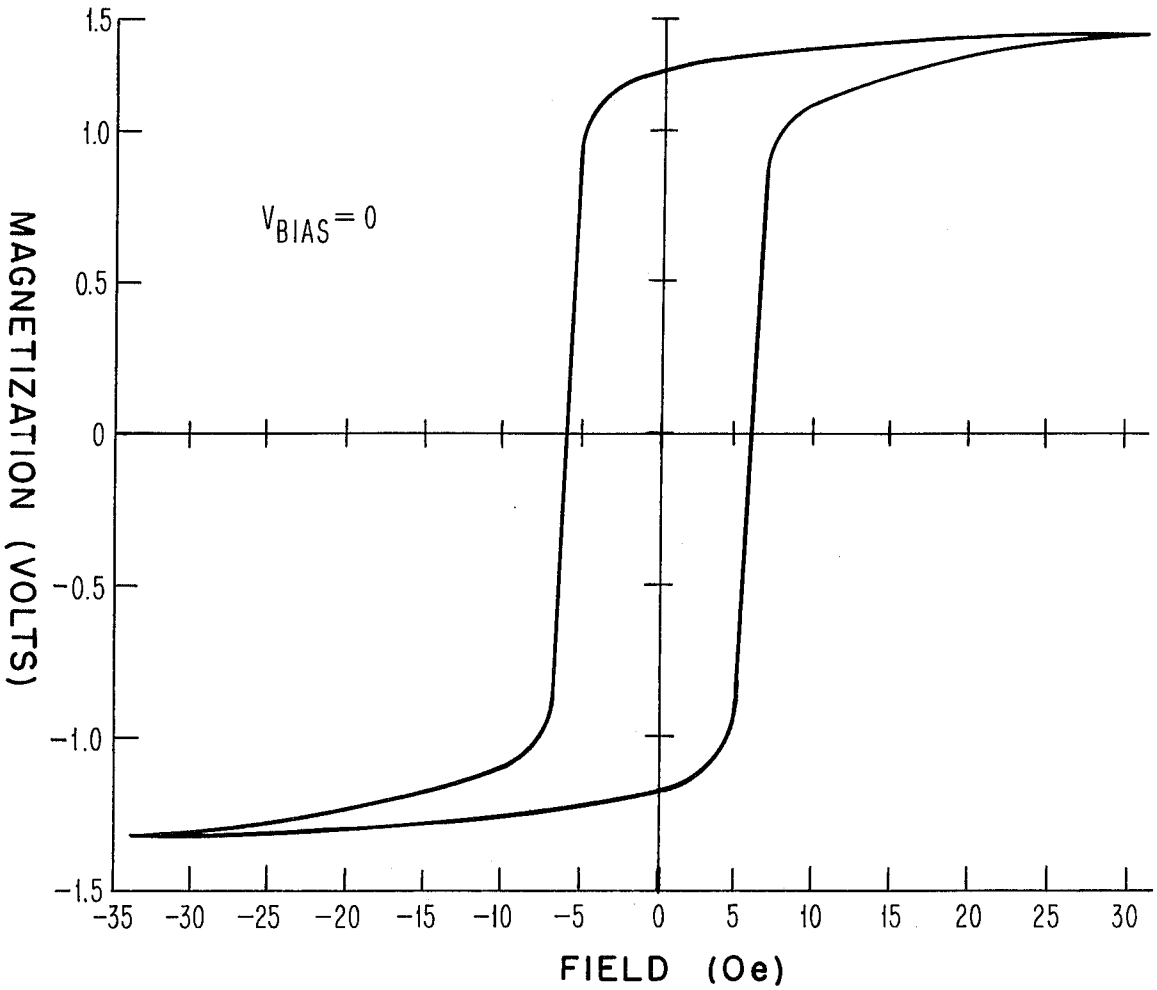
Figure 15E:
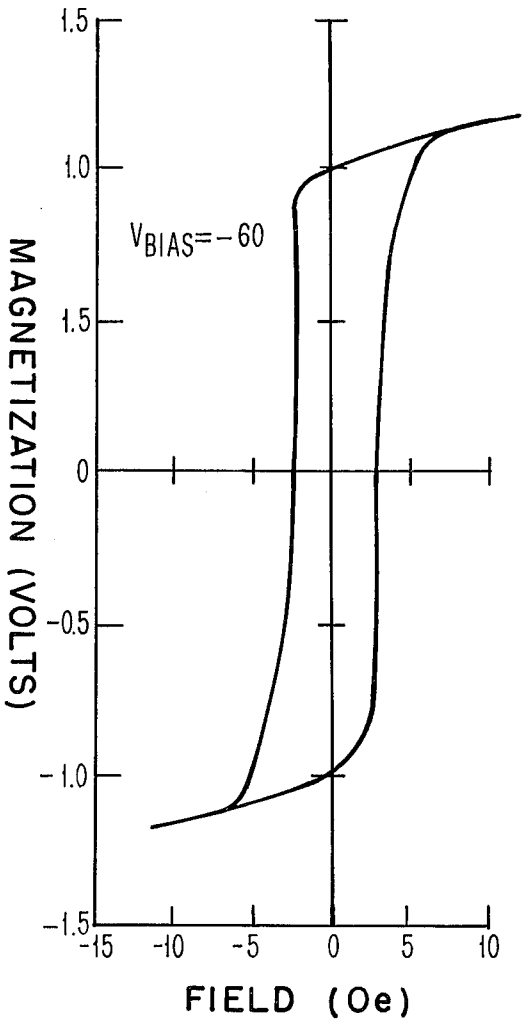
Figure 15D:
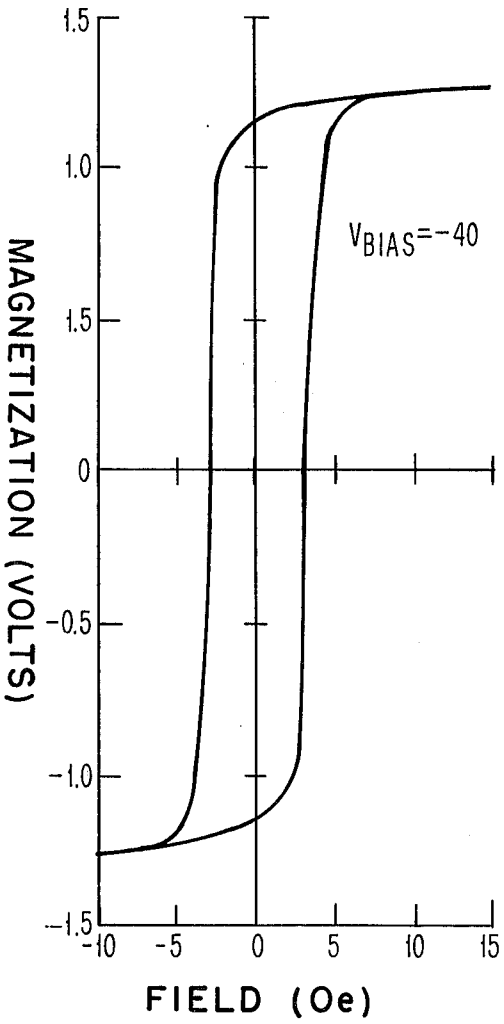
Figure 15C:
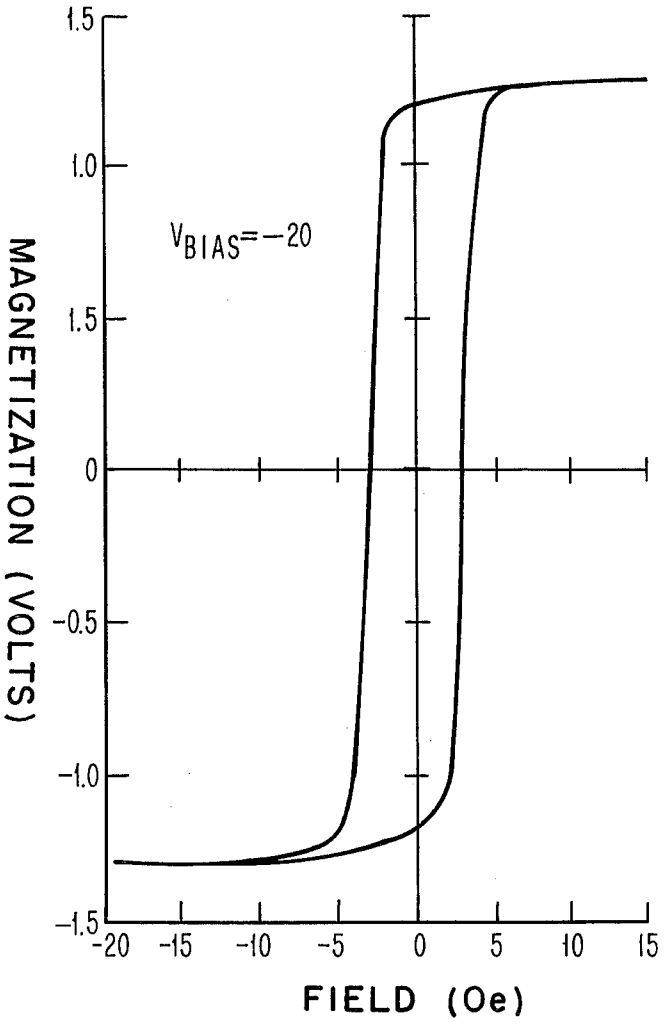
Figure 15G:
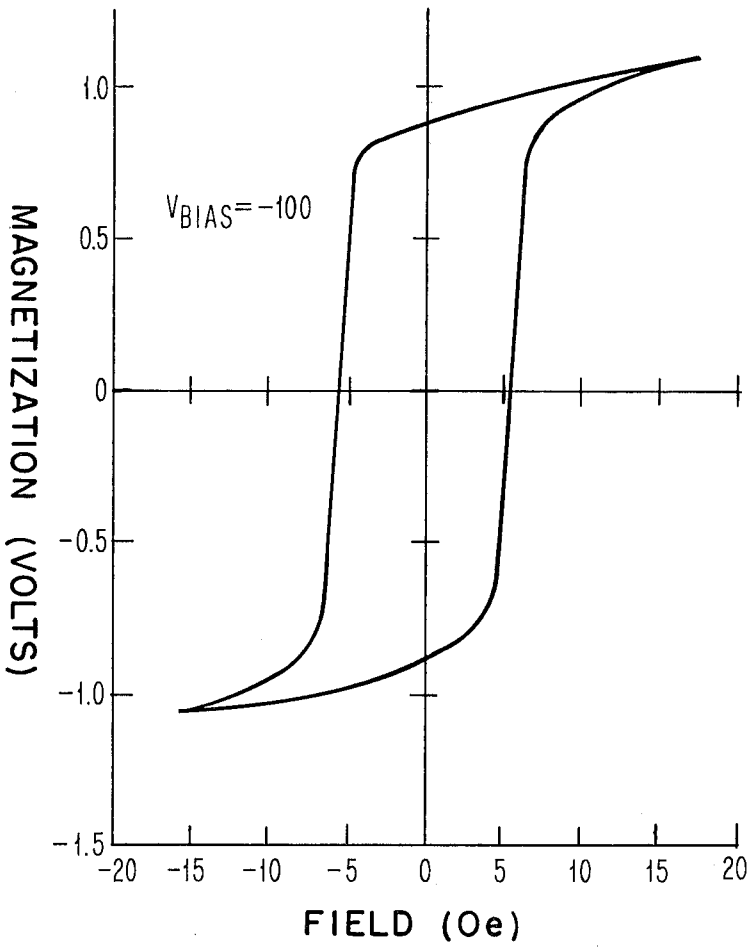
Figure 15F:
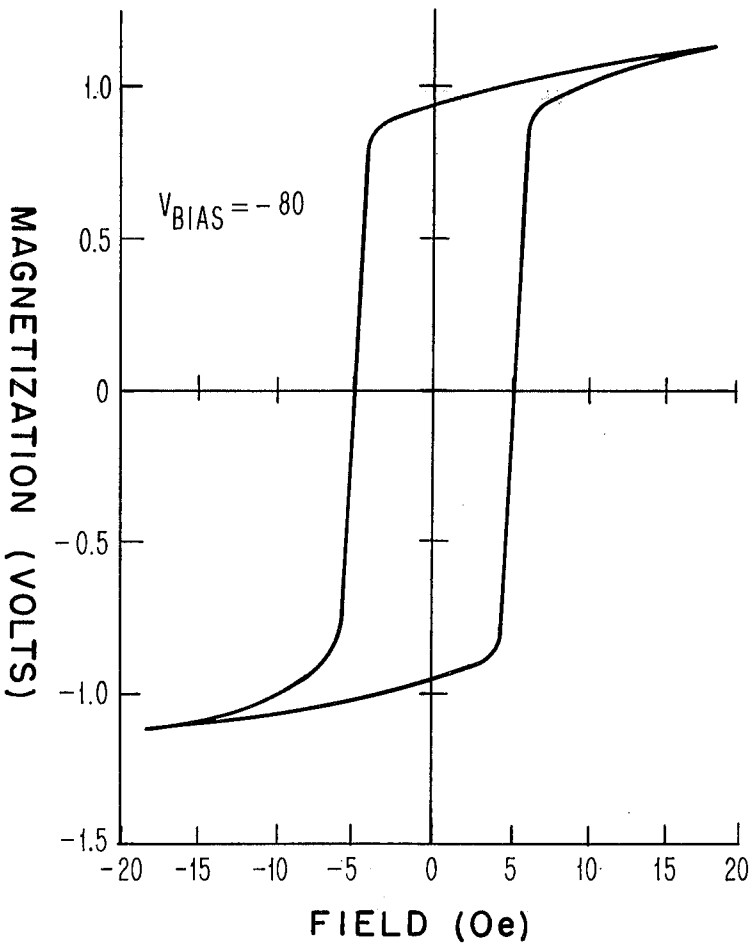
Figure 15I:
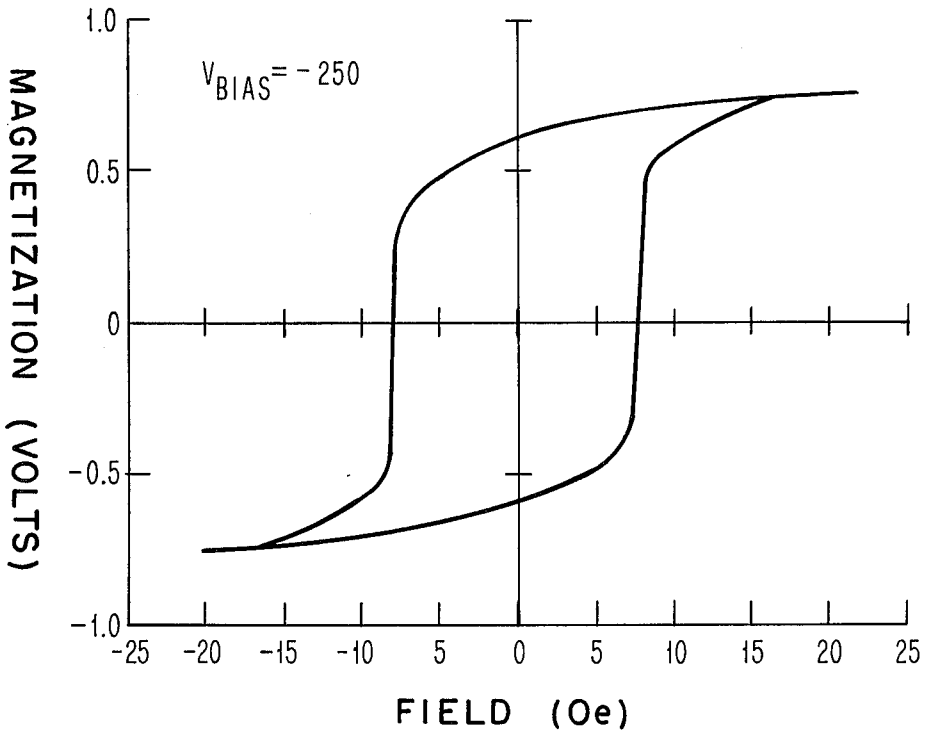
Figure 15H:
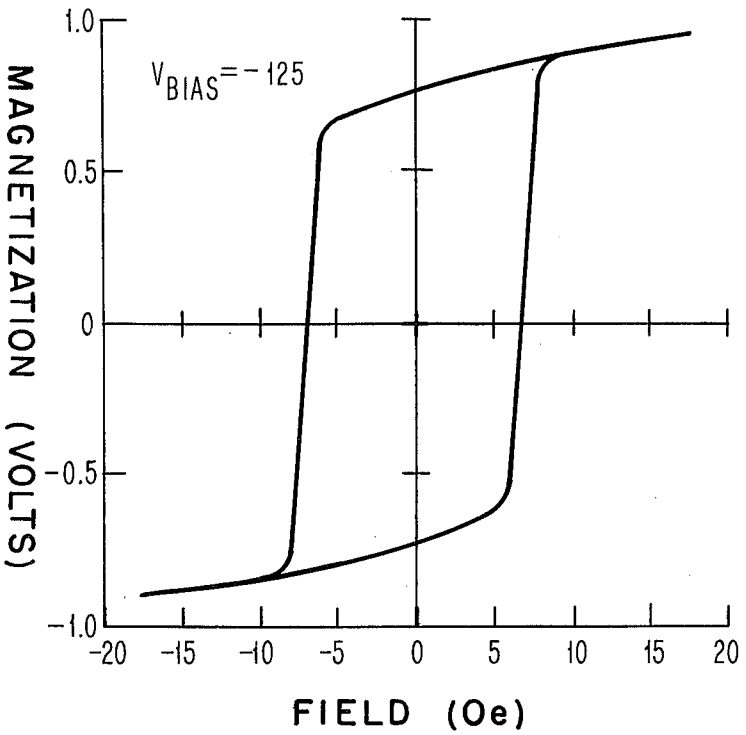

The resultant film produced the hysteresis loop shown in FIG. 15A.

EXAMPLES VIII–XVI

These examples were the same as Example VII, except that the bias values were respectively −17, −20, −40, −60, −80, −100, −125 and −250 yielding hysteresis loops as shown by FIGS. 15B–15I with respective thicknesses of 1.95, 1.91, 1.84, 1.59, 1.62, 1.62, 1.44, and 1.22 microns, and coercivities of 3.2, 3.0, 3.1, 3.1, 4.0, 5.5, 7.0, and 8 Oe. respectively.

FIGS. 15A–I show that the effect of increasing the negative bias beyond about −17 volts is to flatten and broaden the hysteresis curves.

Figure 16:
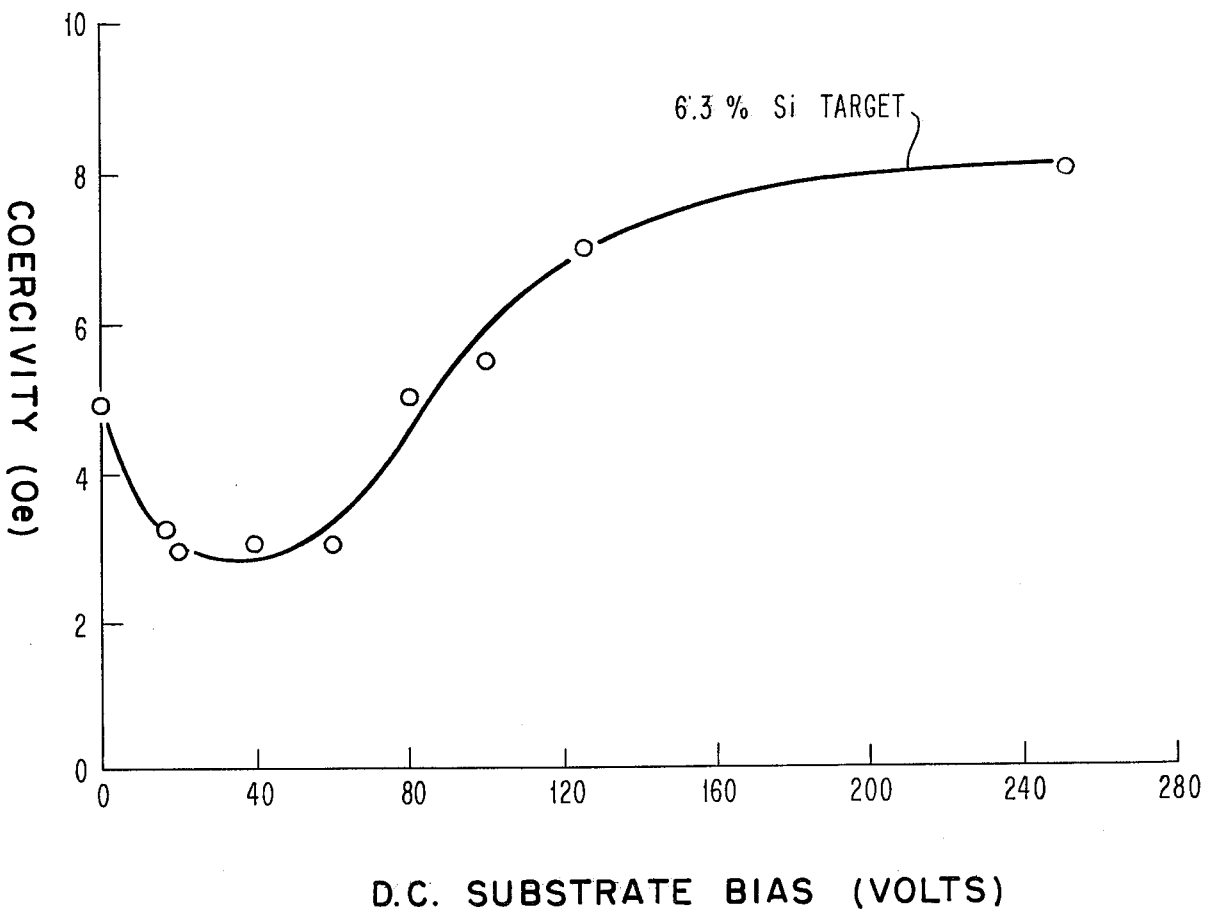
FIG. 16 shows a plot of coercivity vs. substrate bias.
Figure 17:
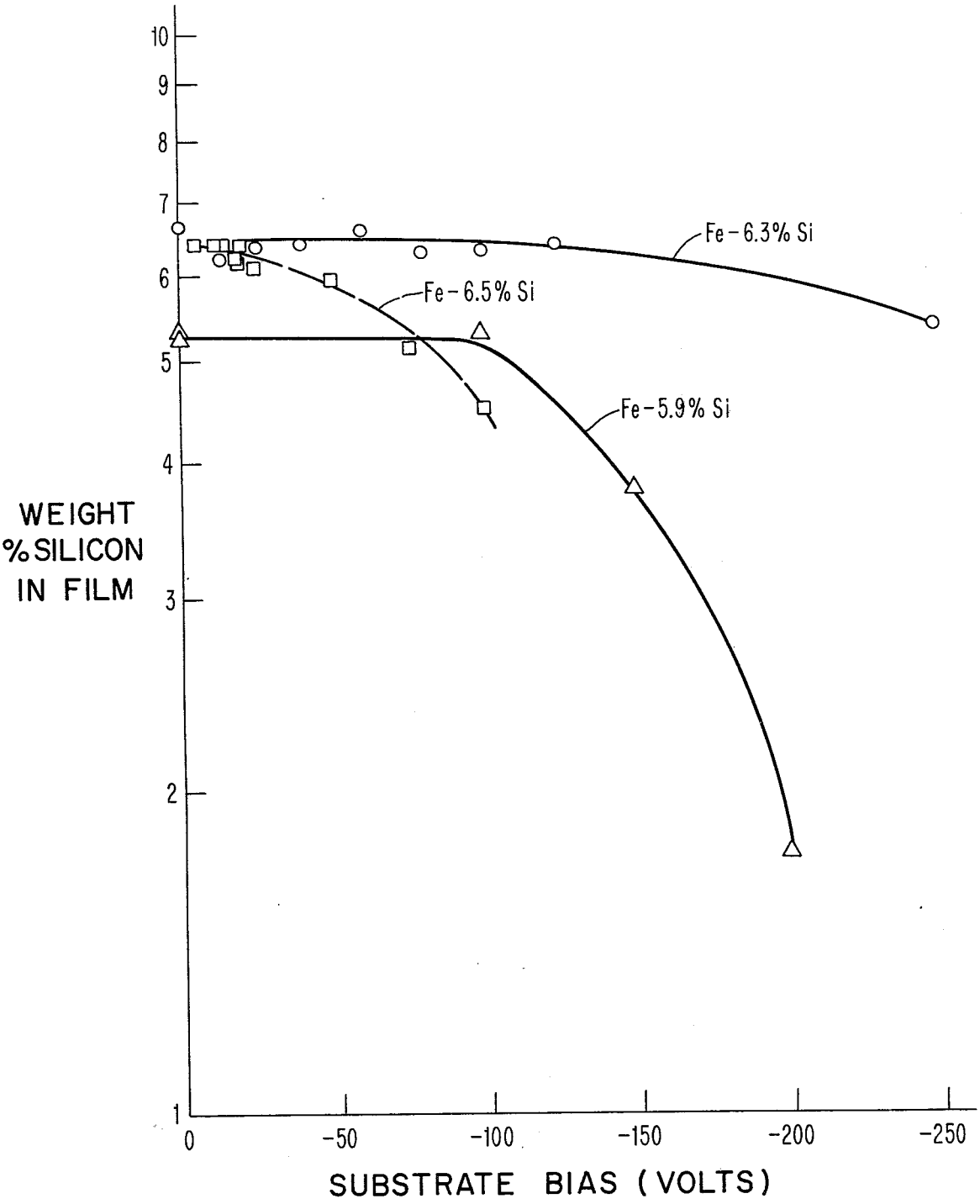
FIG. 17 shows silicon content as a function of substrate bias.

In FIG. 16, the coercivity of the samples of Examples VII to XVI are shown as a function of substrate bias. A fairly broad minimum occurs at about −40 volts d.c. substrate bias. Electron microprobe analysis of oxygen content show significantly greater amounts of oxygen are present in films of 0 bias than in the other films in this group, probably accounting for the higher coercivity of that set of samples. Electron microprobe analyses of silicon content in films made by sputtering targets and in different sputtering systems shown in FIG. 17 shows a sharp drop off of silicon content of the films as the negative substrate bias exceeds about −100 volts. However, in the region from 0 to −75 volts, the silicon content remains constant or decreases slightly with increasing negative substrate bias (depending upon the significance attached to analytical results). Thus oxygen included in the films probably accounts for the high coercivity at low substrate bias and loss of silicon accounts for high coercivity at very high substrate biases. In the middle range from −5 to −60 volts, the reasons for variations in coercivity may be more subtle.

Effect of Substrate Temperature

EXAMPLE XVII

An Fe - Si film was R.F. sputter deposited from an Fe - Si target onto an oxidized silicon wafer. The conditions were as follows:

| | |
|---|---|
| Target composition | Fe-6.3% Si |
| Sputtering time | 30 minutes |
| Argon pressure | 20 microns |
| Substrate temperature | 550° C |
| R.F. power level | 20 watts/in$^2$ |
| Deposition rate | 600 Å/min |
| Anode-Cathode separation distance | 1.4 inches |
| Film thickness | 1.93 microns |
| Substrate bias | −20 volts |
| Cathode potential | 2200 volts |
| Coercivity | 2.8 Oe |

Figure 18C:
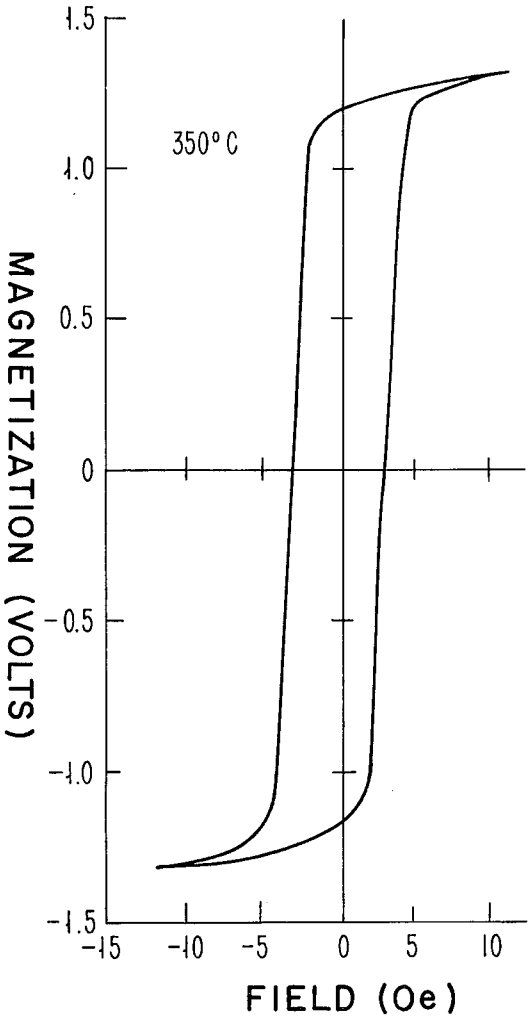
FIGS. 18A–H show hysteresis curves for varying values of substrate temperature.
Figure 18B:
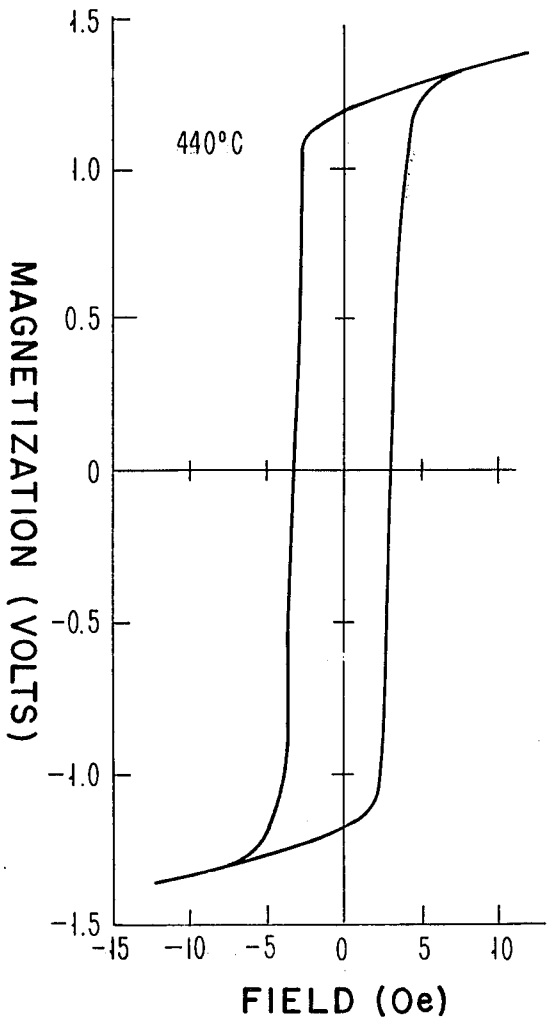
Figure 18A:
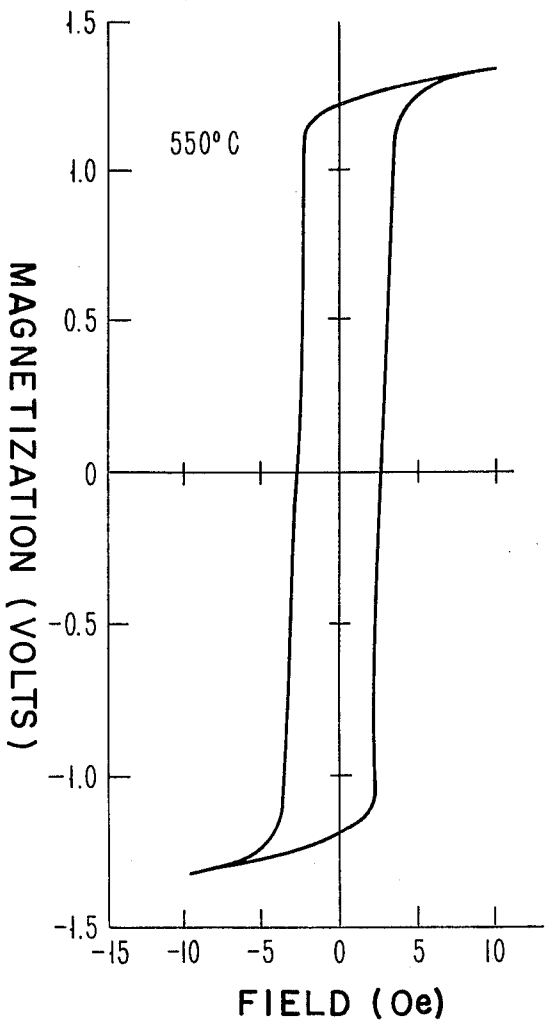
Figure 18D:
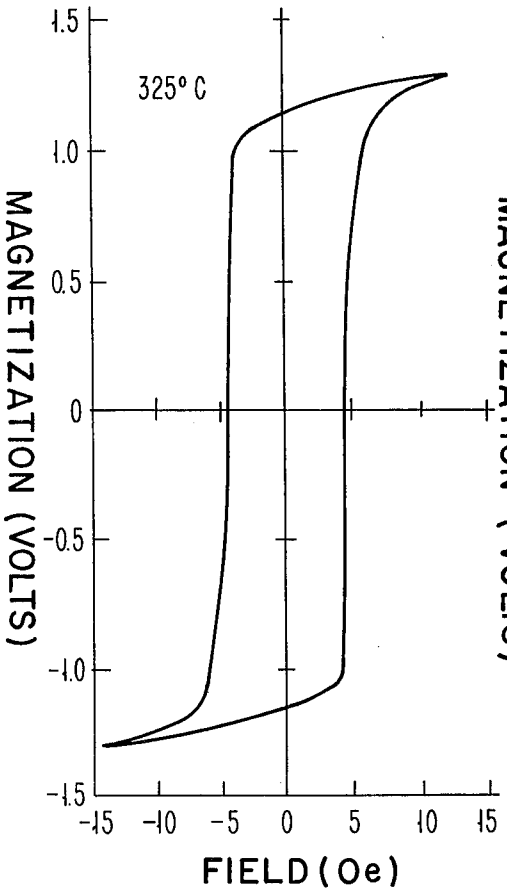
Figure 18E:
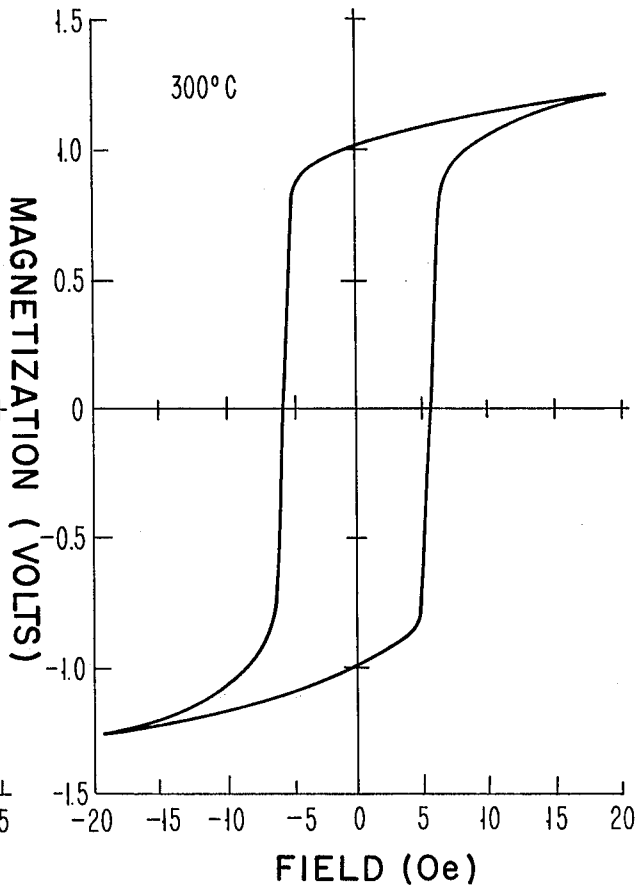
Figure 18F:
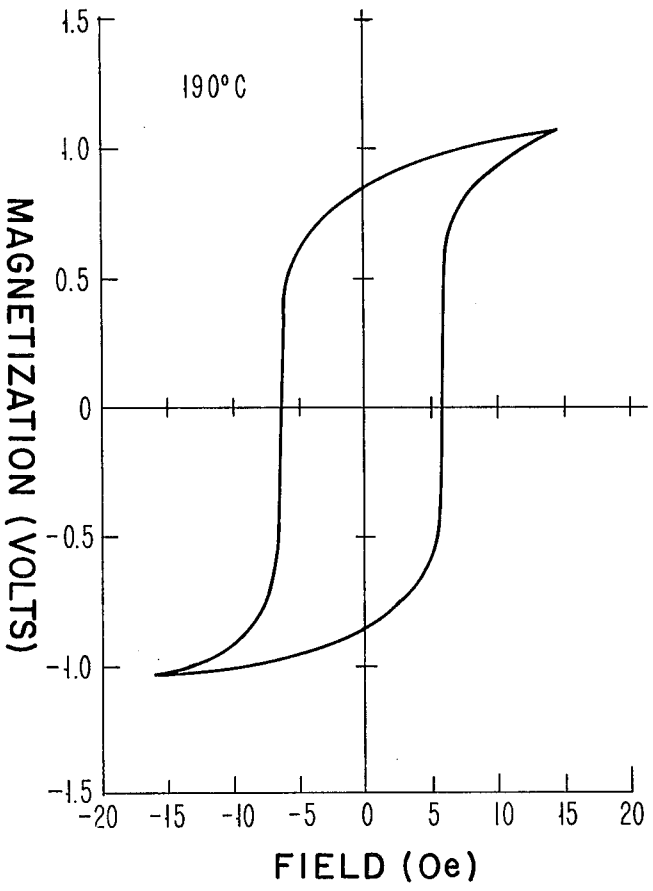
Figure 18H:
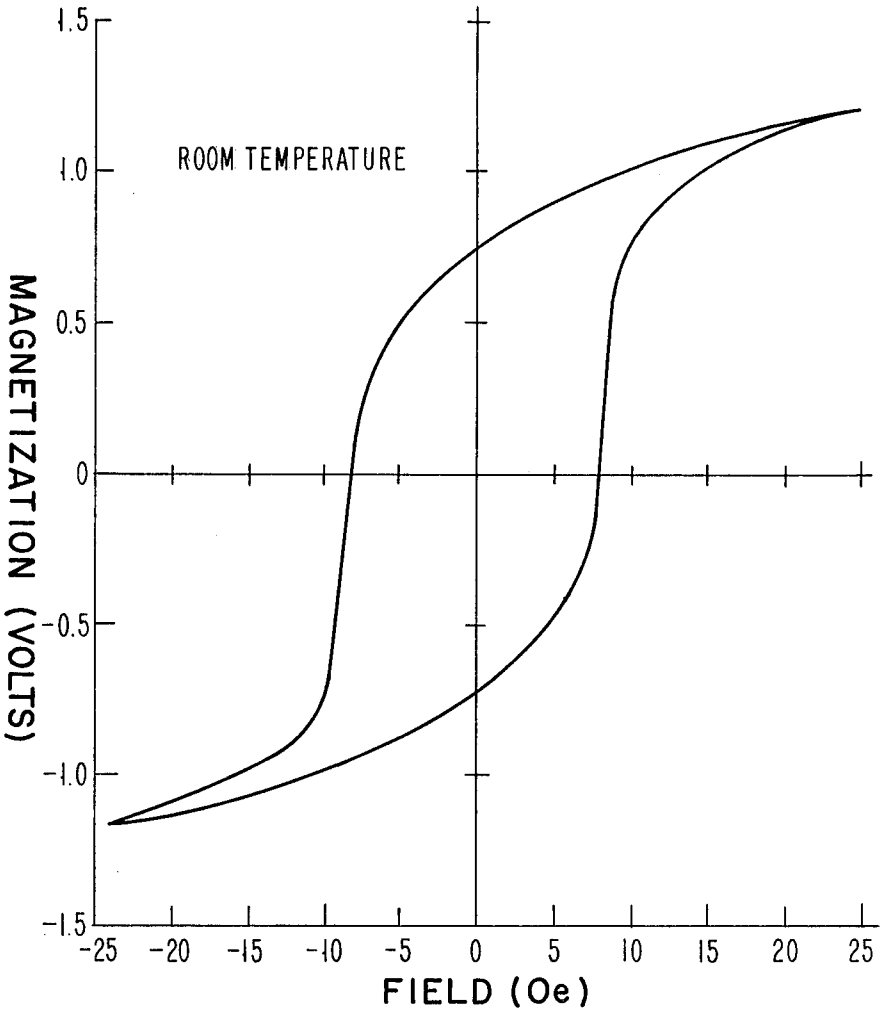
Figure 18G:
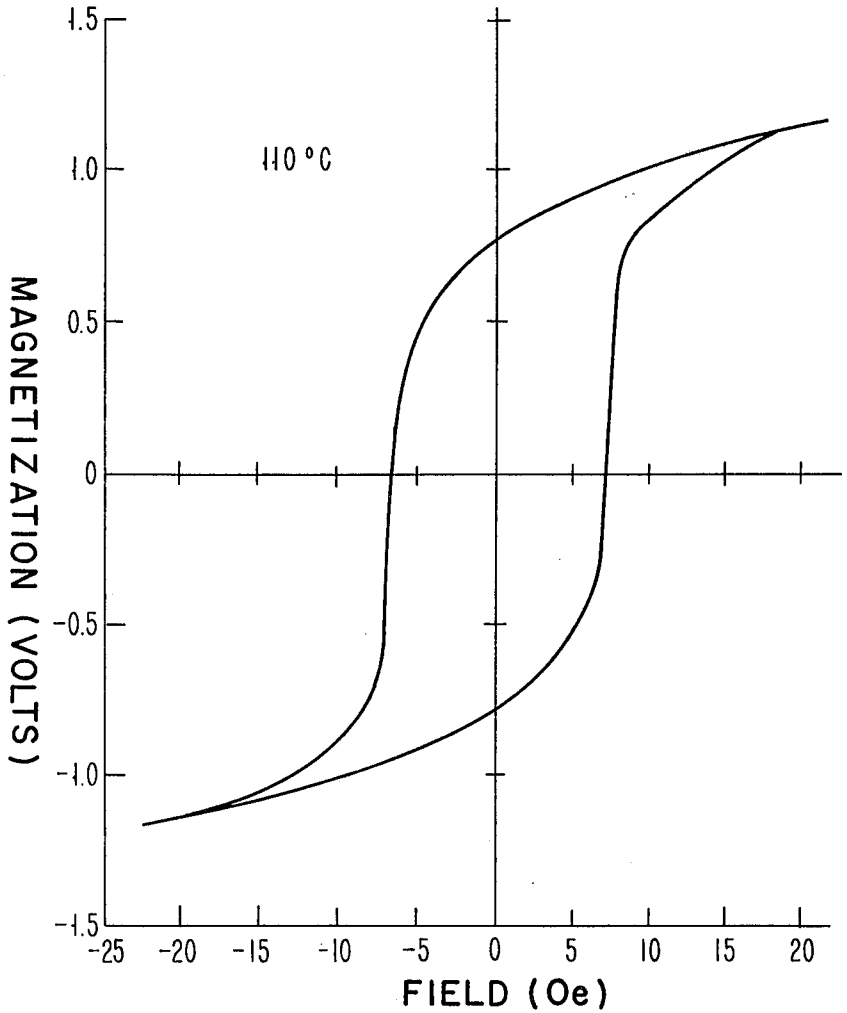

The resultant film produced the hysteresis loop shown in FIG. 18A.

EXAMPLES XVIII–XXIV

These examples are the same as Example XVII except that the substrate temperature is 440° C, 350° C, 325° C, 190° C, 110° C and room temperature respectively. The resultant films produced yielded the hysteresis loops shown in FIGS. 18B–18H. Coercivities are shown in FIG. 19.

As the substrate temperature drops below 350° C, the resulting films becomes more coercive and the hysteresis loops assume a form recognizable as similar to films possessing normal (out of plane) anisotropy. It is believed that film stress operating through a relatively low magnetostriction plays a role in determining the nature of the hysteresis loop. The relative importance of intrinsic stress and thermal stress has yet to be determined. Intrinsic stress is expected to be higher at low deposition temperatures (as well as high deposition rates). Such stress reflects submicroscopic nonequilibrium structural features. Thermal stress, on the other hand, by contrast with the intrinsic stress, increases as a function of deposition temperature.

The magnetostriction of these random [110] Fe - Si (b.c.c.) films has been measured to be positive in the plane.

Figure 19:
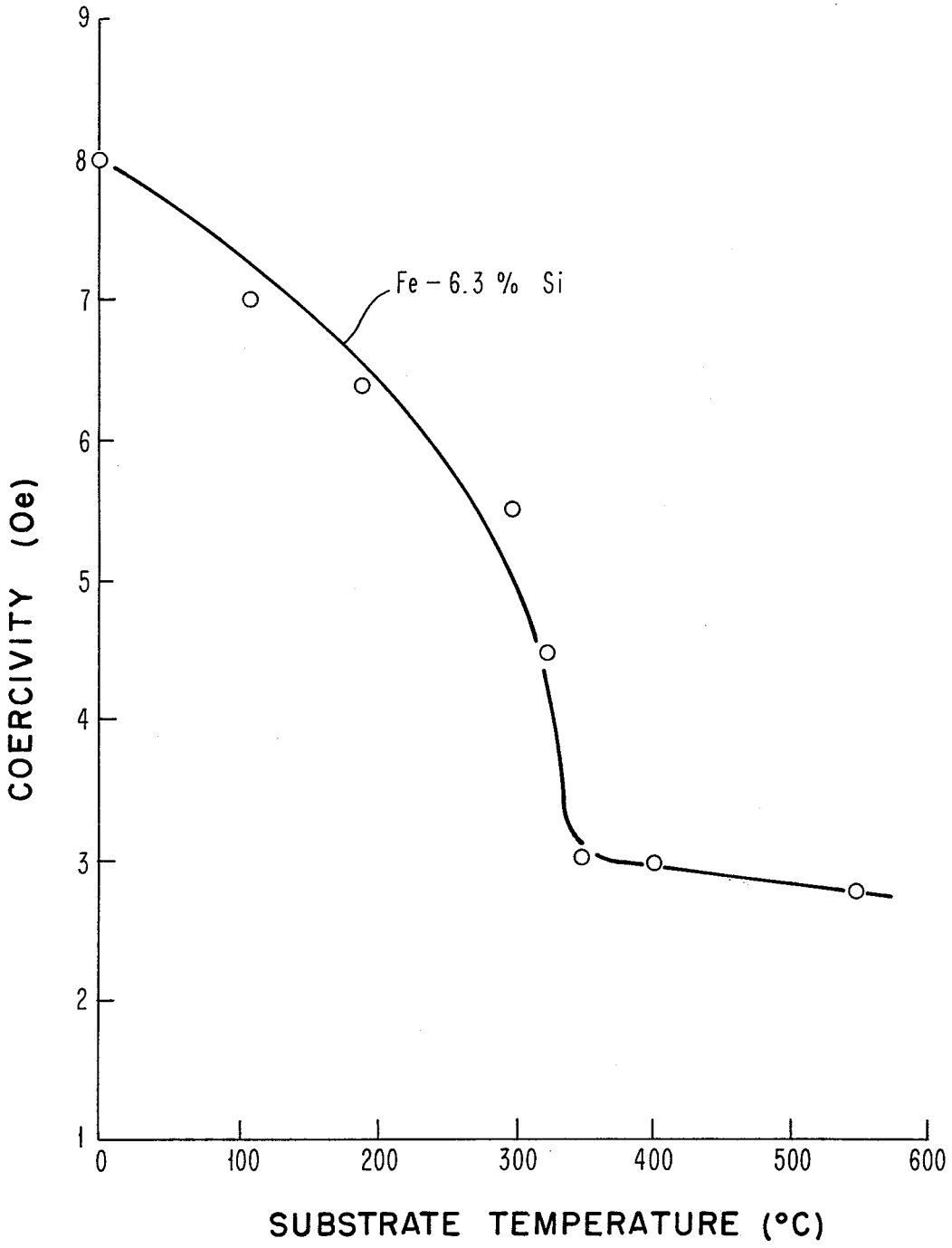
FIG. 19 shows coercivity as a function of substrate temperature.

FIG. 19 shows the dependence of coercivity on substrate temperature. Inspection of FIG. 19 reveals that above 325° C, the coercivity falls rapidly and then remains constant (or decreases very slowly) beyond 350° C. In earlier experiments, results for which are shown in FIGS. 9–12, with sputtering targets having lower silicon content in different sputtering systems, the coercivity was observed to pass through a minimum in the 325° C to 425° C range.

Effect of Argon (Sputtering Gas) Pressure

EXAMPLE XXV

An Fe - Si film was R.F. sputter deposited from an Fe - Si target onto an oxidized silicon wafer. The conditions were as follows:

| | |
|---|---|
| Target composition | Fe-6.3% Si |
| Sputtering time | 30 minutes |
| Argon pressure | 33 microns |
| Substrate temperature | 400° C |
| R.F. power level | 20 watts/in$^2$ |
| Deposition rate | 450 Å/min |
| Anode-Cathode separation distance | 1.4 inches |
| Film thickness | 1.35 microns |
| Substrate bias | −30 to −45 volts |
| Cathode potential | 1650 volts |
| Coercivity | 3.2 Oe |

Figure 20A:
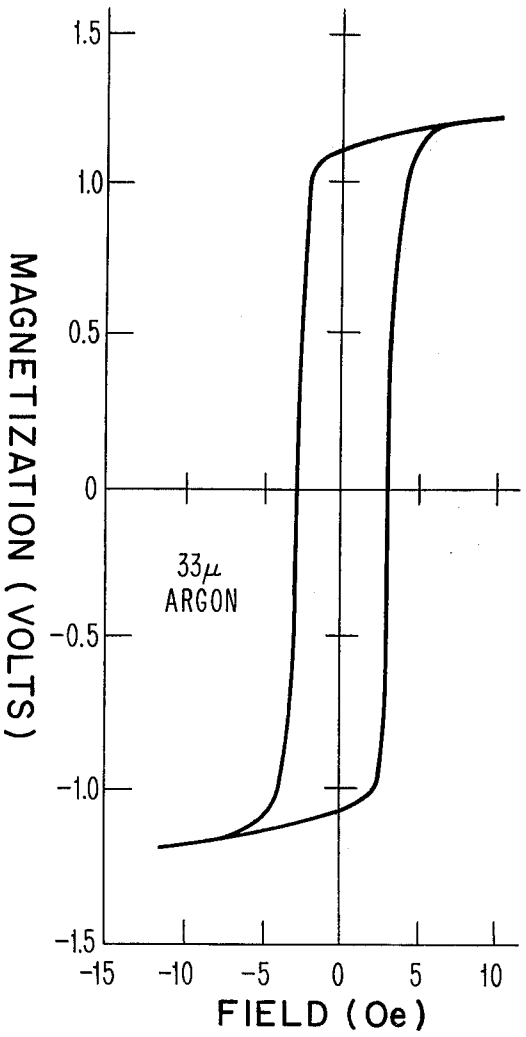
FIGS. 20A–E show hysteresis curves for varying values of argon (sputtering gas) pressure.
Figure 20B:
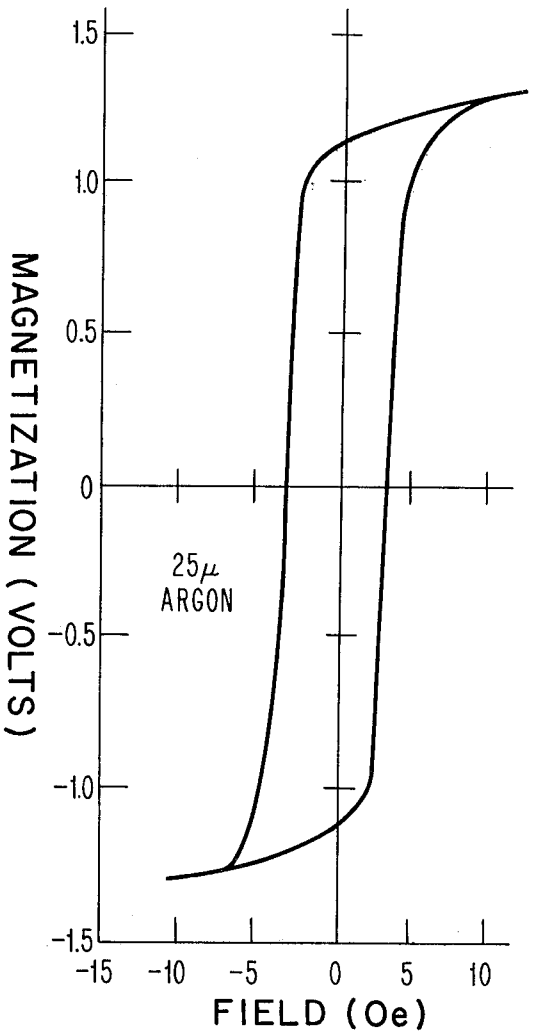
Figure 20C:
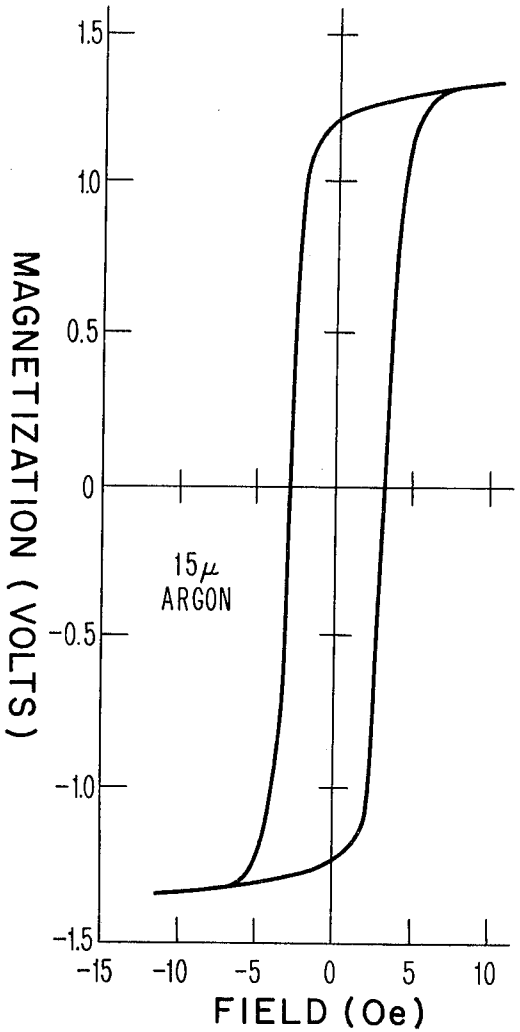
Figure 20E:
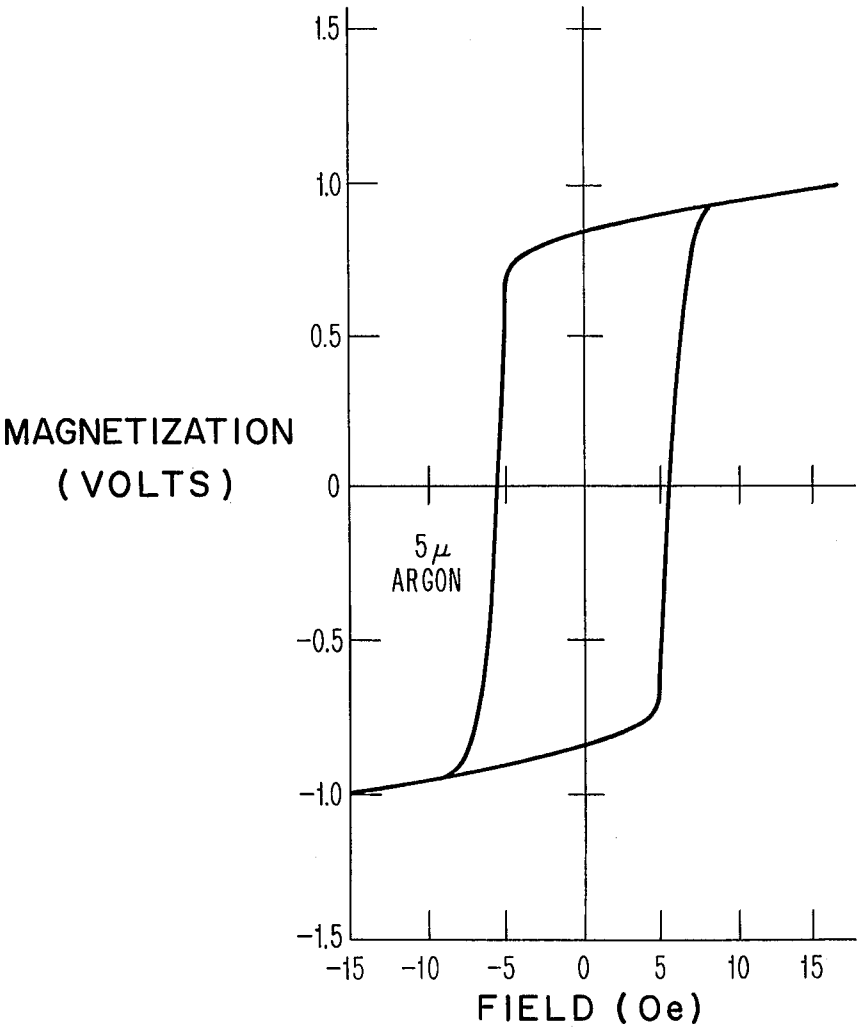
Figure 20D:
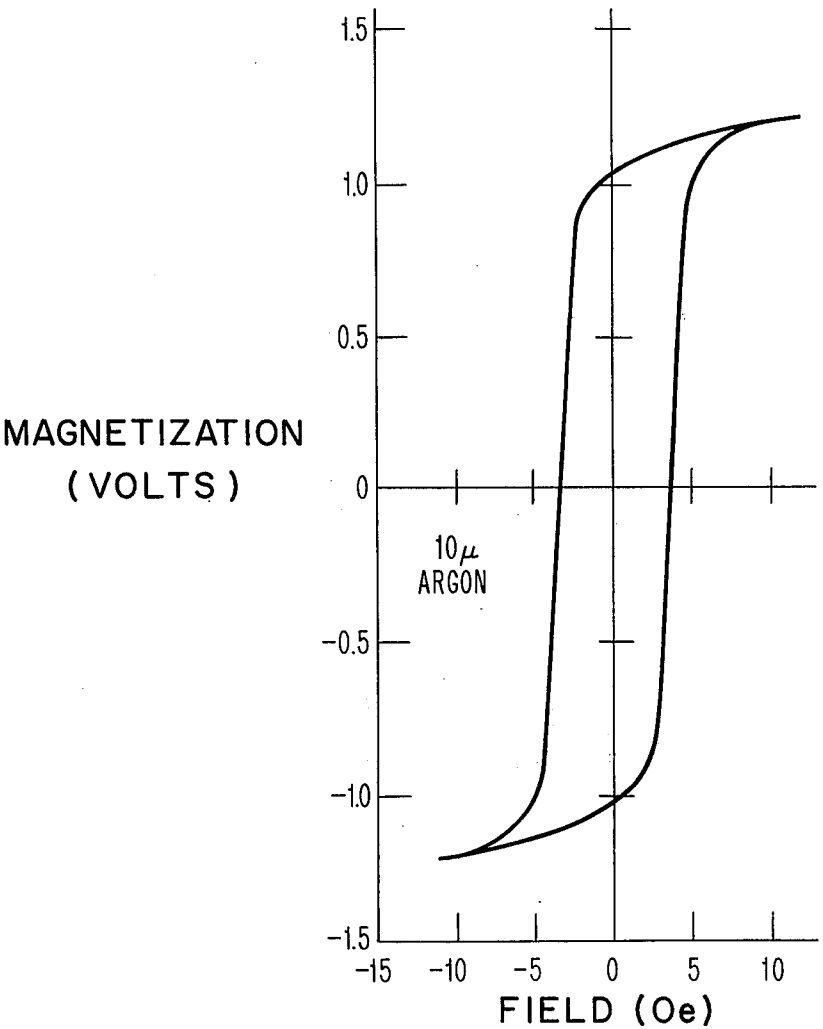

The resultant film produced the hysteresis loop shown in FIG. 20A.

EXAMPLES XXVI–XXIX

Figure 21:
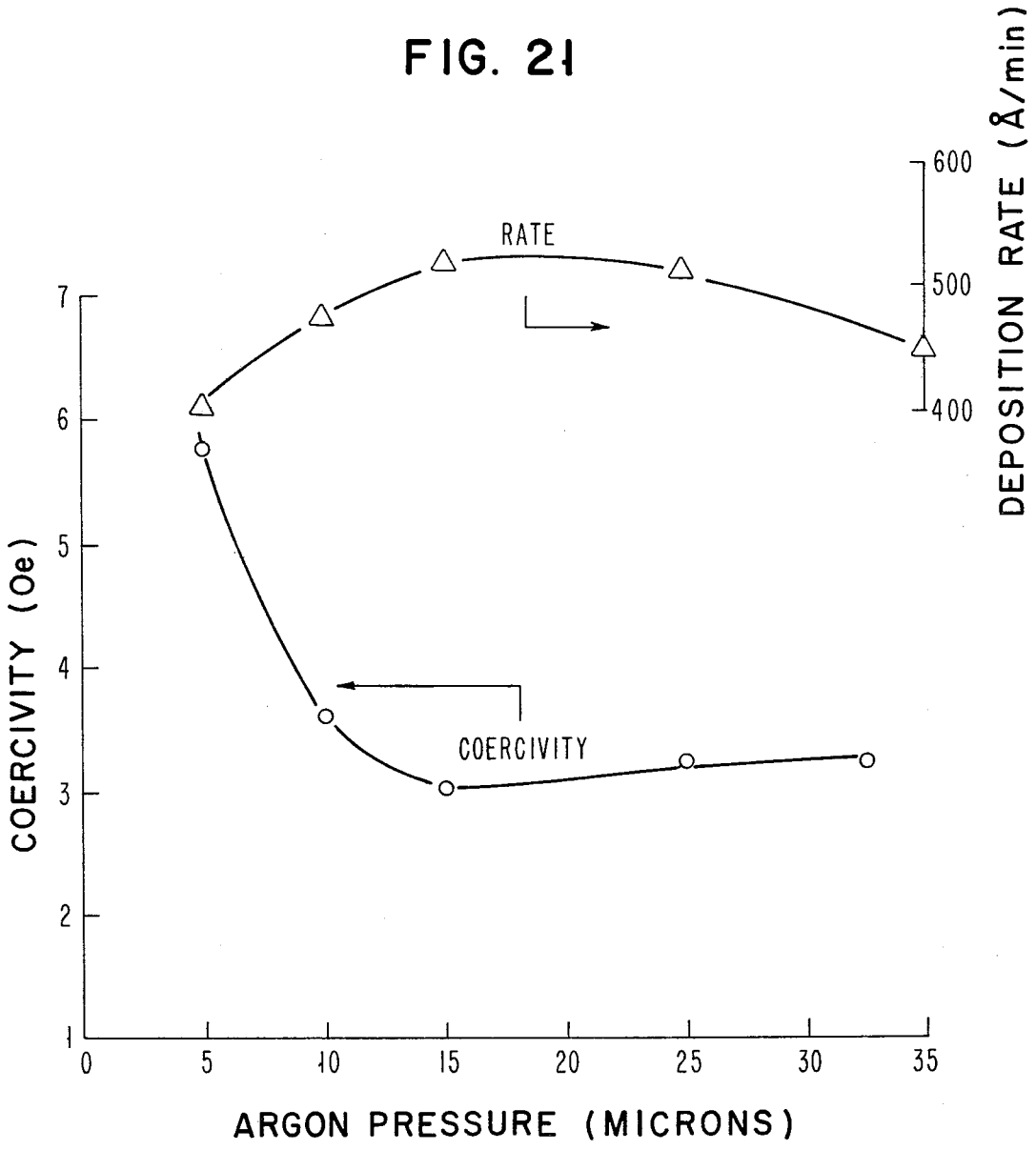
FIG. 21 shows deposition rate and coercivity as a function of argon pressure.

These examples are the same as Example XXV except that the argon pressures (film thicknesses) are 25 (1.53$\mu$), 15 (1.55$\mu$), 10 (1.44$\mu$), 5 (1.23$\mu$) microns respectively, and the deposition rates are shown in FIG. 21. The coercivities are 3.2, 3.0, 3.6, and 5.75 with cathode voltages of 1900, 2350, 2550, and 2750, respectively. The resultant films produced had the hysteresis loops shown in FIGS. 20B–20E.

FIGS. 20A–E show the effect of argon pressure upon the hysteresis loops of the films involved. FIG. 21 shows the dependence of the deposition rate and the coercivity, with other variables held constant, upon the argon pressure. The deposition rate passes through a maximum at 15–20 microns and coercivity is low above 10 microns and fairly independent of argon pressure above 15 microns. Below 10 microns, coercivity is sharply larger.

Effect of Film Thickness

EXAMPLE XXX

An Fe - Si film was R.F. sputter deposited from an Fe - Si target onto an oxidized silicon wafer. The conditions were as follows:

| | |
|---|---|
| Target composition | Fe-6.3% Si |
| Sputtering time | 90 minutes |
| Argon pressure | 20 microns |
| Substrate temperature | 400° C |
| R.F. power level | 20 watts/in$^2$ |
| Deposition rate | 600 Å/min |
| Anode-Cathode separation distance | 1.4 inches |
| Film thickness | 4.75 microns |
| Substrate bias | −20 volts |
| Cathode potential | 2200 volts |
| Coercivity | 2.2 Oe |

Figure 22A:
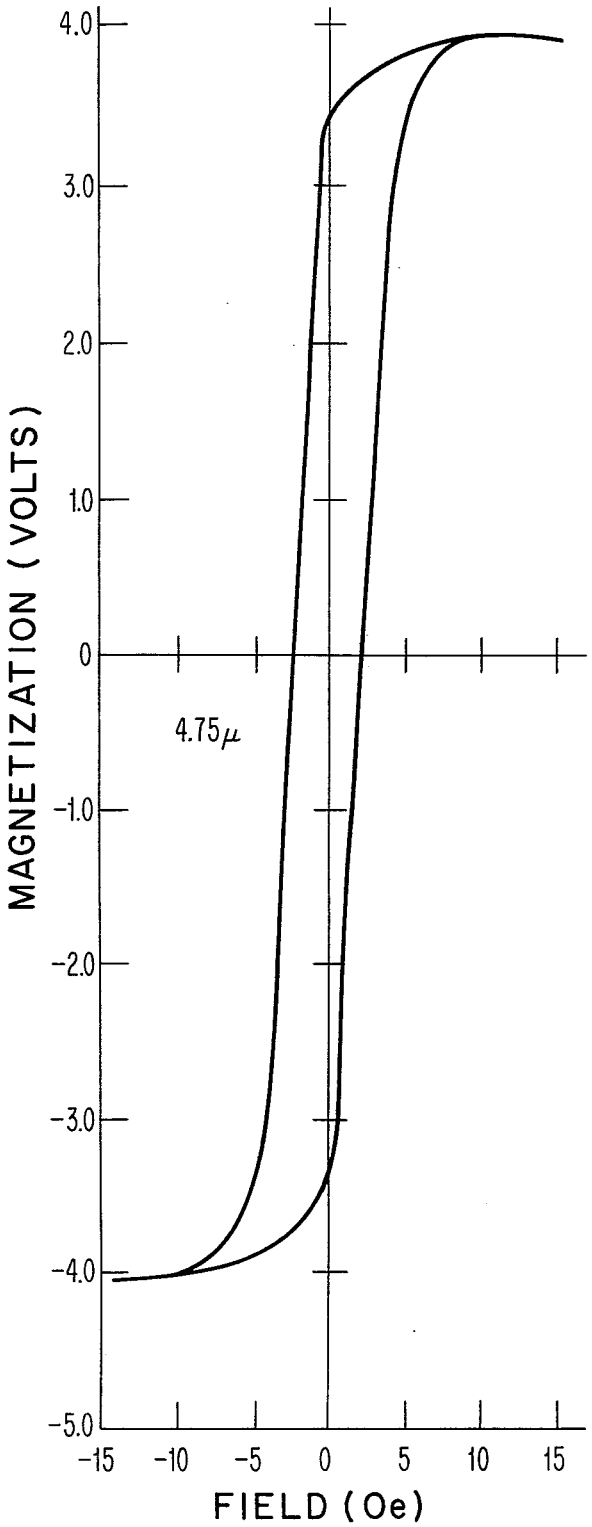
FIGS. 22A–E show hysteresis curves for varying values of film thickness.
Figure 22B:
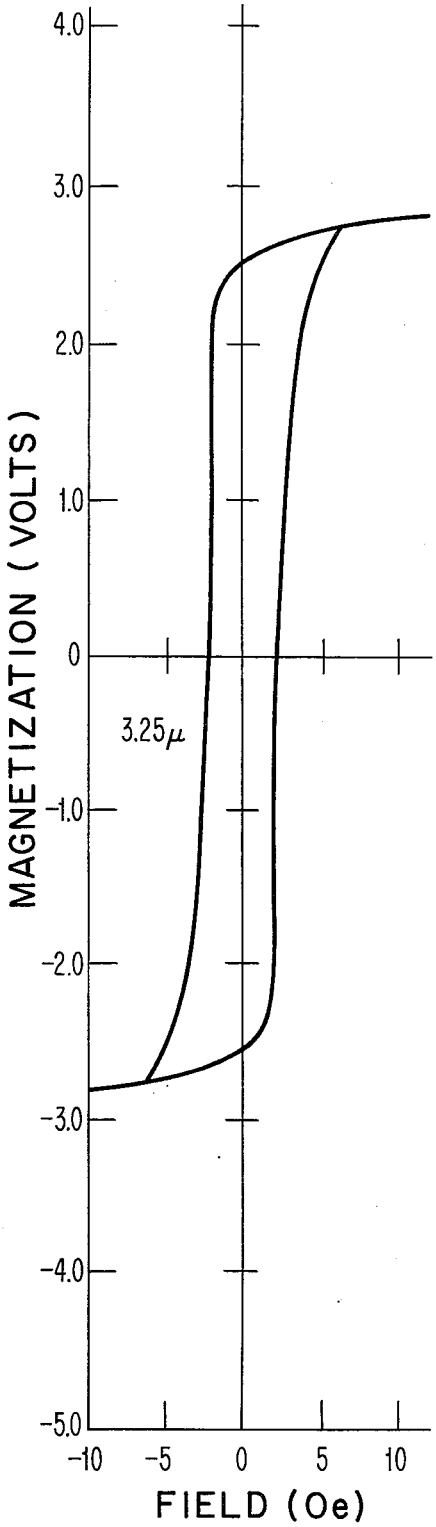
Figure 22C:
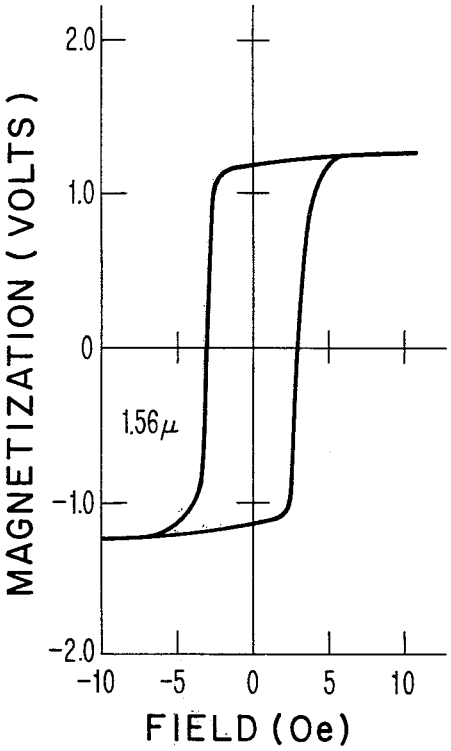
Figure 22D:
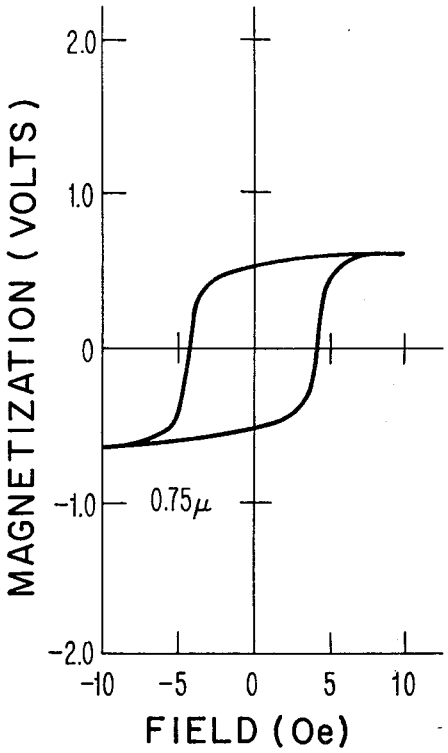
Figure 22E:
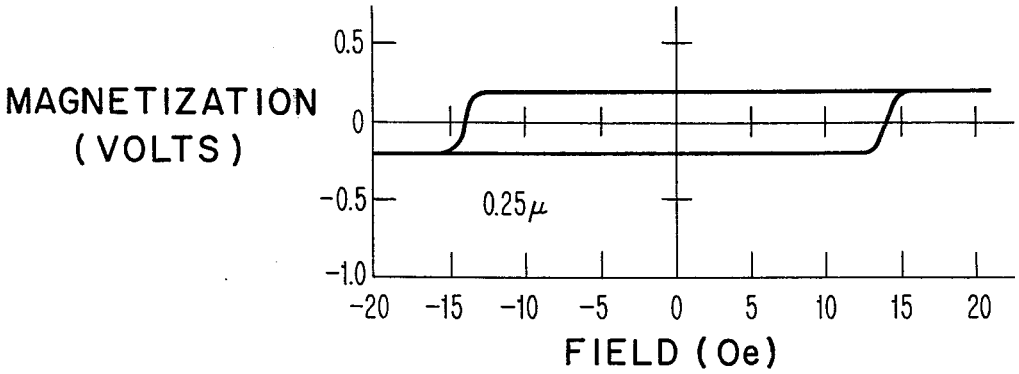

The resultant film produced the hysteresis loop shown in FIG. 22A.

EXAMPLES XXXI–XXXIV

Figure 23:
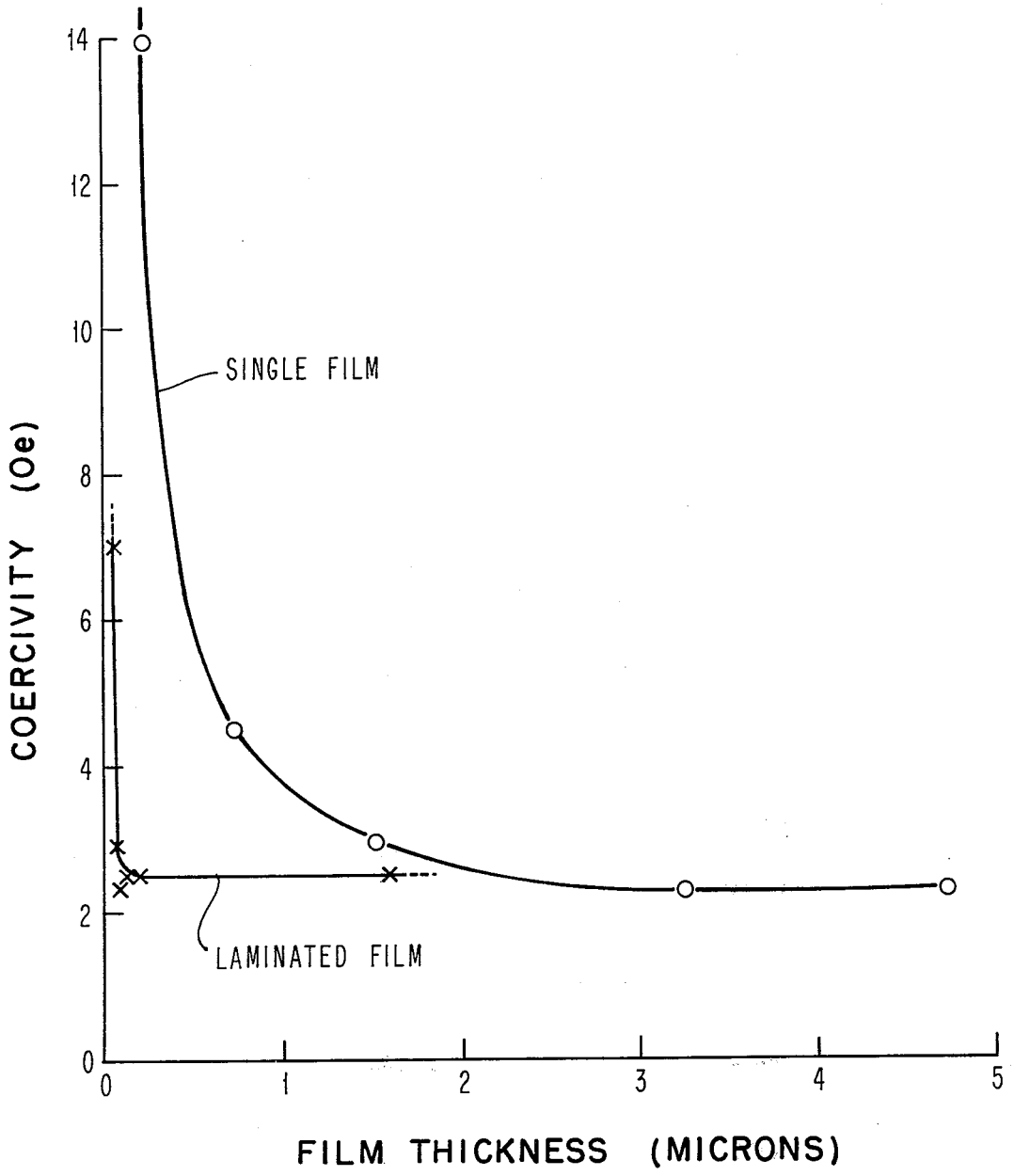
FIG. 23 shows coercivity as a function of film thickness.

These examples are the same as Example XXX except that the film thicknesses (and sputtering times) are 3.25 (60 min), 1.56, (30 min), 0.75 (15 min), and 0.25 (5 min) microns respectively. The resultant films produced had the hysteresis loops shown in FIGS. 22B–22E. Coercivities are shown in FIG. 23.

FIGS. 22A–E show the effect of varying film thickness upon the hysteresis loops of Fe - 6.5% Si. The amplitude of the hysteresis loop increases linearly with film thickness. FIGS. 22 and 23 show that coercivity is weakly dependent upon film thickness beyond two microns of thickness. Below one micron, coercivity increases rapidly as thickness is reduced. Single film thickness should be greater than 0.4 micron for low coercivity.

MISCELLANEOUS

1. Sputtering Targets Lower in Silicon Content

Targets lower in silicon content of 5.9% and 6.1% Si applied in a different sputtering system known as the "Yorktown T System" (rather than the "Materials Research Corporation 822 Sputtersphere System" used for Examples I–XXXIV. Films of quite low coercivity have also been prepared.

Best Single-layer Films

EXAMPLE XXXV

An Fe - Si film was R.F. sputter deposited in the Yorktown T system from an Fe-Si target onto an oxidized silicon wafer. The conditions were as follows:

| | |
|---|---|
| Target composition | Fe - 6.1% Si |
| Sputtering time | 60 minutes |
| Argon pressure | 20 microns |
| Substrate temperature | 410° C |
| R.F. power level | 8 watts/in$^2$ |
| Deposition rate | 167 Å/min |
| Anode-cathode separation distance | about 1.5 inches |
| Film thickness | 0.98 microns |
| Substrate bias | −12.5 volts |
| Cathode potential | about 2000 volts |
| Coercivity | 1.2 Oe |

Figure 24:
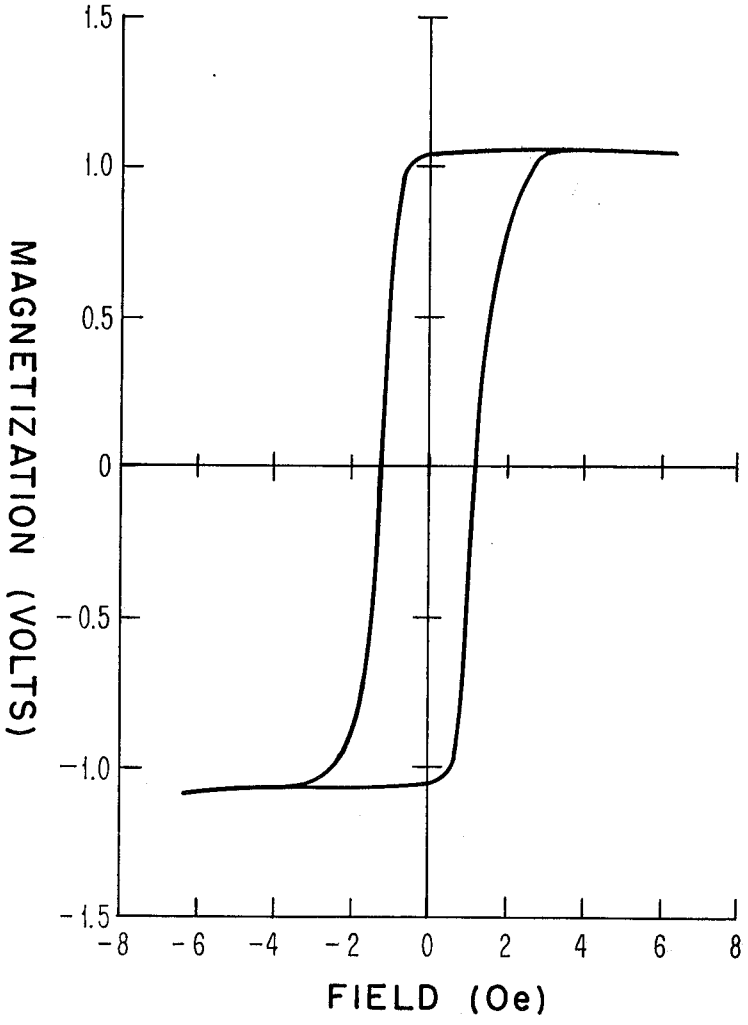
FIG. 24 shows a hysteresis curve for a target having a lower silicon content produced in a different system.

The resultant film produced the hysteresis loop shown in FIG. 24

EXAMPLE XXXVI

An Fe - Si film was R.F. sputter deposited from an Fe - Si target onto an oxidized silicon wafer. The conditions were as follows:

| | |
|---|---|
| Target composition | Fe - 5.9% Si |
| Sputtering time | 60 minutes |
| Argon pressure | 20 microns |

-continued

| | |
|---|---|
| Substrate temperature | 390–400° C |
| R.F. power level | about 12 watts/in$^2$ |
| Deposition rate | 333 Å/min |
| Anode-cathode separation distance | about 1.5 inches |
| Film thickness | 2.0 microns |
| Substrate bias | −40 volts |
| Cathode voltage | 2000 volts |
| Coercivity | 1.2 Oe |

FIG. 24 shows a hysteresis loop of one such superior film (6.1% silicon from Example XXXV) having a coercivity of 1.2 Oe. It is believed that the superior coercivity is attributable to a lower content of magnetostrictive silicon in the target making the film produced somewhat more magnetostrictive. The thermal tensile stress created in the film upon cooling from the deposition temperature to room temperature would, because of this increased magnetostriction, be more effective in forcing the magnetic anisotropy to be planar, which agrees with experimental results (FIGS. 9 and 19).

2. Laminated Structures

It is also possible to obtain superior films by laminating thin layers of Fe - Si with thin layers of $SiO_2$. Coercivities of 0.8 Oe can be obtained routinely in this manner.

EXAMPLE XXXVII

An Fe - Si film was R.F. sputter deposited from an Fe - Si target onto an oxidized silicon wafer. The conditions were as follows:

| | |
|---|---|
| Target composition | Fe - 6.3% Si |
| Sputtering time | 2 min/layer |
| Argon pressure | 20 microns |
| Substrate temperature | 400° C |
| R. F. power level | 20 watts/in$^2$ |
| Deposition rate | 561 Å/min |
| Anode-cathode separation distance | 1.0 inches |
| Aggregate Fe-Si film thickness | 1.46 microns |
| Substrate bias | −40 volts |
| Cathode voltage | 1850 volts |
| Film thickness of $SiO_2$ | 73 Å |
| Number of layers | 13 Fe-Si, 13 $SiO_2$ |
| $SiO_2$ thickness | 73 Å per layer |
| Total magnetic thickness | 1.46 microns |
| Coercivity | 0.8 Oe |

Figure 25:
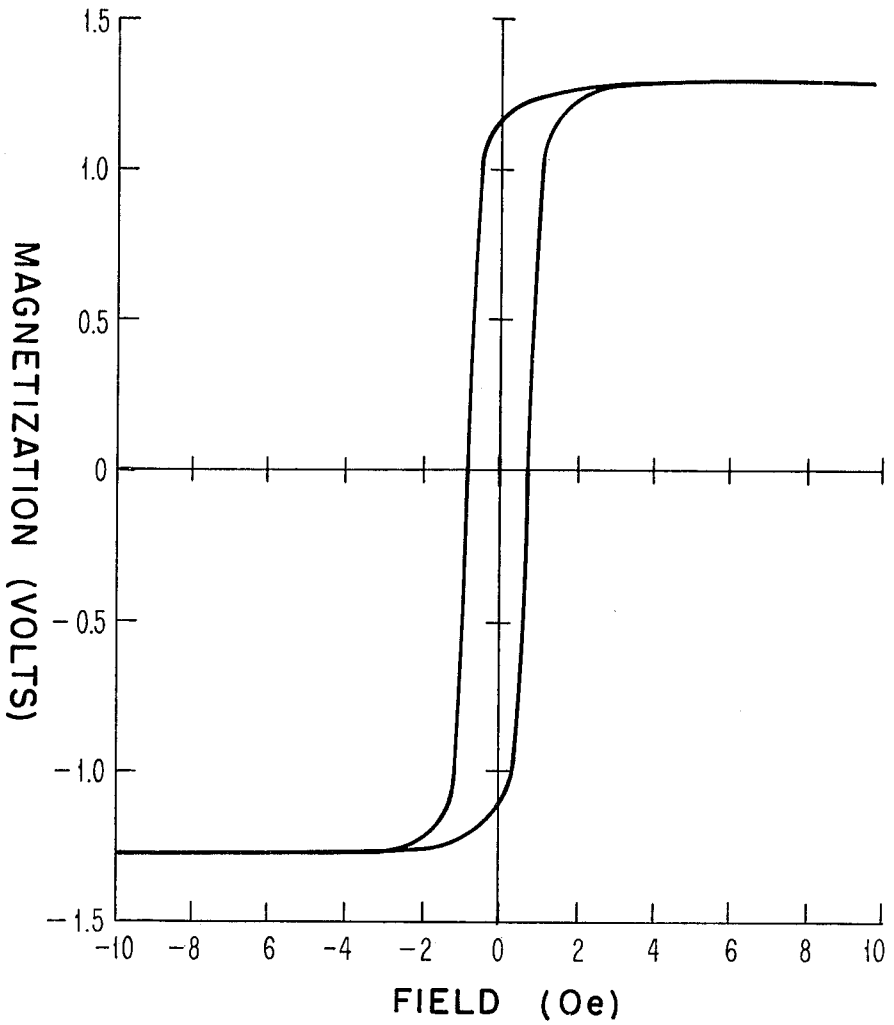
FIG. 25 shows a hysteresis curve of a laminated film structure.

FIG. 25 shows the hysteresis loop for the film of Example XXXVII.

EXAMPLE XXXVIII

A laminated Fe - Si film structure was R.F. sputter deposited from an Fe - Si target onto an oxidized silicon wafer. The conditions were as follows:

| | |
|---|---|
| Target composition | Fe - 6.3% Si |
| Sputtering time | 2 min/layer |
| Argon pressure | 20 microns |
| Substrate temperature | 400° C |
| R.F. power level | 20 watts/in$^2$ |
| Deposition rate | 580 Å/min |
| Anode-cathode separation distance | 1.0 inches |
| Fe-Si film thickness/layer of Fe-Si | 0.261 microns |
| $SiO_2$ film thickness | 73 Å |
| Substrate bias | −40 volts |
| Coercivity | 2.2 Oe |
| Film thickness $SiO_2$ | 723 Å/layer |
| Number of layers | 2 Fe-Si, 2 $SiO_2$ |

EXAMPLE XXXIX

Four layers were deposited in a similar way to those of Example XXXVIII. The results were an aggregate of Fe-Si 0.47 microns thick with a coercivity of 1.6 Oe.

EXAMPLE XL

Eight layers were deposited in a similar way to those of Example XXXVIII. The results were an aggregate of Fe - Si 0.88 microns thick with a coercivity of only 1.4.

EXAMPLE XLI

For 16 layers and similar conditions to those of Example XXXVIII. The aggregate of Fe - Si was only 1.86 microns thick with a low coercivity of 0.9.

Double Layers of Fe - Si Separated by $SiO_2$

EXAMPLE XLII

A laminated Fe - Si structure was R.F. sputter deposited from an Fe - Si target onto an oxidized silicon wafer. The conditions were as follows:

| | |
|---|---|
| Target composition | Fe - 6.3% Si |
| Sputtering time | 0.5 min/layer |
| Argon pressure | 15 microns |
| Substrate temperature | 400° C |
| R.F. power level | 20 watts/in$^2$ |
| Deposition rate | 500 Å/min |
| Anode-cathode separation distance | 1.4 inches |
| Film thickness Fe-Si/layer | .05/2 microns |
| Substrate bias | −40 volts |
| $SiO_2$ thickness | 73 Å |

The resultant film produced a coercivity of 7 Oe shown in FIG. 23. Similar points are shown in FIG. 23 for various aggregate film thicknesses of Fe - Si.

15 Layers of Fe - Si Separated by $SiO_2$

EXAMPLE XLIII

A laminated Fe - Si film structure was R.F. sputter deposited from an Fe - Si target onto an oxidized silicon wafer. The conditions were as follows:

| | |
|---|---|
| Target composition | Fe - 6.3% Si |
| Sputtering time/Fe-Si layer | 2 min |
| Argon pressure | 20 microns |
| Substrate temperature | 200° C |
| R.F. power level | 20 watts/in$^2$ |
| Deposition rate | 533 Å/min |
| Anode-cathode separation distance | 1.0 inch |
| Fe-Si film thickness Fe-Si/15 | 1.6/15 |
| $SiO_2$ layer thickness (20 sec/layer) | 25 Å |
| Number of layers | 15 Fe-Si, 15 $SiO_2$ |
| Substrate bias | −40 volts |
| Cathode voltage | 2150 volts |

The resultant film produced the coercivity in FIG. 9 for 200° C, and similar examples yielded the other points shown on the curve for the same parameters except substrate temperature.

Ranges of Sputtering Conditions

It has been found on the basis of the above data and other experimental work that there are certain parameters required to produce a sputtered film having a coercivity less than 6 Oersteds for a single film and even lower for the same conditions for a laminated film having layers of about 1000A each of Fe - Si. The conditions are as follows:

| | |
|---|---|
| Target composition | 4 - 7% Si |
| Cathode-anode spacing | ½" to 2" |
| Cathode (target) R.F. potential | greater than 1200 volts |
| Anode (substrate) bias | −2.5 to −60 volts |
| Anode (substrate) temperature | above 250° C |
| Sputtering gas pressure (argon) | above 10 microns |
| R.F. power level | above 8 watts/in$^2$ |
| Deposition rate | greater than 150 Å/min |
| Composition of Fe-Si-Film | |
| Silicon content | 5 - 7% si by weight |
| Thickness (single film) | >0.4 micron |
| Aggregate Fe-Si thickness (laminated structure) | >0.05 micron |
| Random [110] (b.c.c.) fiber texture | normal to the plane of the film |
| Coercivity | less than 6 Oe |

We claim:

1. A substrate having deposited thereon a thin film of iron-silicon made by the process comprising the steps of:

placing a substrate upon the anode of an R.F. sputtering chamber, placing a target of iron-silicon containing about 4% to 7% silicon upon the cathode of said sputtering chamber, spacing said cathode and said anode about ½ inch to 2 inches apart, impressing an R.F. potential greater than 1200 volts upon said cathode for sputtering material from said target of iron-silicon at a rate greater than 150A/-min onto said substrate to a thickness greater than ½ micron upon the said substrate, while maintaining a bias between about minus 2.5 and minus 60 volts upon the anode and the substrate to be coated, and maintaining a temperature at the anode above 250° C, in an evacuated atmosphere of argon as a sputtering gas at a pressure above 10 microns, stopping the deposition of iron-silicon upon said substrate by removing potential from said target and said substrate after a layer of iron-silicon has been deposited upon said substrate.

2. A process for manufacturing a substrate having deposited thereon an iron-silicon magnetic thin film coating comprising the steps of:

placing a substrate upon the anode of an R.F. sputtering chamber, placing a target of iron-silicon containing 4% to 7% silicon upon the cathode of said sputtering chamber, spacing said cathode and said anode about ½ inch to 2 inches apart, impressing an R.F. potential greater than 1200 volts upon said cathode for sputtering a thin film coating of iron-silicon from said target of iron-silicon at a rate greater than 150A/min onto said substrate to a thickness greater than about 0.05 micron aggregate thickness of laminated iron-silicon and about 0.4 micron for a single layer film upon said substrate, while maintaining a bias between about minus 2.5 and minus 60 volts upon the anode and the substrate to be coated, with an R.F. input power above the 8 watts/in$^2$ range and maintaining a temperature at the anode over 250° C, in an evacuated atmosphere of argon as a sputtering gas at a pressure above 10 microns, then stopping the deposition of said coating of iron-silicon upon said substrate by removing potential from said target and said substrate after said coating of iron-silicon has been deposited to a thickness of greater than 0.4 micron upon said substrate for a single film and greater than 0.05 micron thickness for a single layer of a laminated film coating of iron-silicon.

3. A process in accordance with claim 2 including, depositing an electromagnetic transducing element upon said substrate coated with said coating of iron-silicon, and depositing an additional thin film coating of iron-silicon over said magnetic transducing element to a thickness of greater than 0.4 micron upon said element for a single film and greater than 0.05 micron thickness for a single layer or a laminated film coating of iron-silicon, employing the steps described above.

* * * * *